US007921481B2

(12) United States Patent
Kimura et al.

(10) Patent No.: US 7,921,481 B2
(45) Date of Patent: Apr. 12, 2011

(54) TOILET BOWL FLUSH DEVICE

(75) Inventors: Motoyasu Kimura, Tokyo (JP); Tomoei Kimura, Tokyo (JP)

(73) Assignee: Kimura Corporation, Setagaya-Ku (JP)

( * ) Notice: Subject to any disclaimer, the term of this patent is extended or adjusted under 35 U.S.C. 154(b) by 1076 days.

(21) Appl. No.: 11/573,971

(22) PCT Filed: Aug. 29, 2005

(86) PCT No.: PCT/JP2005/015688

§ 371 (c)(1),
(2), (4) Date: Mar. 1, 2007

(87) PCT Pub. No.: WO2006/022412

PCT Pub. Date: Mar. 2, 2006

(65) Prior Publication Data

US 2007/0261158 A1 Nov. 15, 2007

(30) Foreign Application Priority Data

Aug. 27, 2004 (JP) ..... 2004-248950

(51) Int. Cl.
*E03D 3/12* (2006.01)

(52) U.S. Cl. ..... 4/326

(58) Field of Classification Search ..... 4/324–327
See application file for complete search history.

(56) References Cited

FOREIGN PATENT DOCUMENTS

| | | | |
|---|---|---|---|
| JP | 50-053943 | U1 | 5/1975 |
| JP | 51-056041 | U1 | 5/1976 |
| JP | 55-161130 | A1 | 12/1980 |
| JP | 2001-323530 | A1 | 11/2001 |

*Primary Examiner* — Huyen Le
(74) *Attorney, Agent, or Firm* — Burr & Brown

(57) ABSTRACT

A toilet bowl flush device where the quantity of water to be discharged can be accurately quantified is provided where a cistern can be reduced in size. The toilet bowl flush device for discharging flush water in a cistern has a water discharge pipe for toilet bowl flushing, where the toilet bowl flush device has a water intake pipe with a water intake opening within the cistern and a water discharge start valve for introducing priming water, that starts the water discharge into the water intake pipe. Further, a trap for forming an air stagnation section is positioned in the middle of the water intake pipe midway between the water intake opening and the water discharge start valve with the position of the air stagnation section being formed at a higher relative position than that of the water intake opening.

11 Claims, 18 Drawing Sheets

TOILET BOWL FLUSH DEVICE

FIELD OF THE INVENTION

The present invention relates to a toilet bowl flush device, and more particularly, to a technique of discharging flush water with occurrence of a syphon phenomenon.

BACKGROUND OF THE INVENTION

As a flush device for a toilet bowl, there is known, for example, a flush water saving apparatus as disclosed in JP-A-2001-323530.

The flush water saving apparatus includes a main water discharge pipe, a main float valve (float valve for large flushing) provided to the main water discharge pipe, a sub water discharge pipe communicating with the main water discharge pipe, and a sub float (float valve for small flushing) provided to the sub water discharge pipe, and has a structure in which at a time of water discharge for small flushing, the sub float valve opens, thereby allowing an appropriate amount of flush water to be discharged to the main discharge pipe through the sub discharge pipe.

More specifically, in response to an operation of an operation lever, the sub float valve is separated from an open end of the sub water discharge pipe to float, thereby initiating the water discharge. Further, as a water level in a cistern declines by the water discharge, a suction force of the sub water discharge pipe exceeds buoyancy of the sub float valve and the sub float valve closes the open end of the sub water discharge pipe to stop the water discharge.

Meanwhile, according to an intensive study by the inventors of the present invention, there are found various points to be improved with respect to a conventional toilet bowl flush device.

First, as a point to which attention is directed, there is given a point that the conventional toilet bowl flush device uses a float valve to adjust a water discharge amount. However, a movement of the float valve depends on an incidental factor such as water flow caused in the cistern and variation in floating position of the float valve relative to the water discharge pipe. Therefore, it has been difficult to say that the water discharge amount can be accurately adjusted without fail.

Further, in the conventional toilet bowl flush device, the float valves for large flushing and small flushing are accommodated in the cistern, so in order to ensure a requisite amount of flush water in the cistern, increase in size of the cistern is inevitable. Further, in order to ensure strong water flow required for flushing, the high water level needs to be retained at a sufficiently higher position relative to a sub water discharge pipe. In this point as well, the cistern is required to be made larger in a height direction.

The present invention has been made in consideration of the above-mentioned technical background. It is an object of the present invention to provide a toilet bowl flush device capable of accurately quantifying a water discharge amount. Further, it is an object of the present invention to provide a toilet bowl flush device also capable of downsizing a cistern.

SUMMARY OF THE INVENTION

The present invention provides a toilet bowl flush device which discharges flush water in a cistern to a water discharge path for toilet bowl flushing, and is characterized by including: a water intake pipe having an open end in the cistern; a water discharge start valve for introducing priming water for starting water discharge into the water intake pipe; and a trap for forming an air stagnation section at a position in a midway from the open end to the water discharge start valve of the water intake pipe, the position being a higher position relative to the open end.

According to the toilet bowl flush device of the present invention constructed as described above, a syphon phenomenon occurs in the water intake pipe due to the introduction of the priming water accompanied with the opening of the water discharge start valve. Thus, the flush water in the cistern is forcibly sucked into the water intake pipe to be discharged. Further, the open end of the water intake pipe emerges from water in the cistern due to the decline of the water level accompanied with the water discharge, air for stopping water is taken into the water intake pipe through the emerged open end. Accordingly, the syphon phenomenon is ended due to the introduction of the air. After that, the water discharge through the water intake pipe automatically stops.

That is, in the present invention, the syphon phenomenon occurring in the water intake pipe is utilized to perform water discharge, a time for stopping the water discharge depends only on a change in the water level in the cistern. Accordingly, it becomes possible to accurately supply a given amount of flush water to a water discharge path.

Further, according to the toilet bowl flush device of the present invention, it is possible to discharge a given amount of flush water without using a float valve, therefore the capacity of the cistern can be effectively used. Further, when a suction force of the water intake pipe is accompanied with the occurrence of the syphon phenomenon in performing the water discharge, it is possible to obtain a stable water flow from a start of the water discharge to a stop of the discharge as compared to a conventional water discharge method utilizing a difference in the water level. Thus, it is possible to obtain a higher flush power without setting the high water level to be high. Further, the cistern can be downsized in a height direction thereof.

Further, the toilet bowl flush device according to the present invention may have a structure in which, the water intake pipe has in the midway from the trap to the open end of the water intake pipe an intermediate opening valve, which emerges from water in the cistern as a water level in the cistern declines.

In this structure, the intermediate opening valve is provided in the midway from the trap to the open end of the water intake pipe. Therefore, at the time of opening the intermediate opening valve, when the water level in the cistern reaches the intermediate opening valve, the water stopping air is taken in through the intermediate opening valve. Thus, at the time of opening the intermediate opening valve, the water discharge stops before the water level in the cistern reaches the open end of the water intake pipe. As a result, it becomes possible to discharge a small amount of water through the open end of the water intake pipe. That is, at the time of opening the intermediate opening valve, the limit water level for water discharge raises as compared to the case of the water discharge through the open end of the water intake pipe. As a result, it becomes possible to discharge a small amount of water. Further, the water discharge amount can be arbitrarily adjusted according to a depth setting of the intermediate opening valve relative to the high water level in the cistern.

Further, there may be provided a structure in which the water discharge start valve is provided at a lower position relative to the intermediate opening valve provided in the cistern and in the water intake pipe.

In this structure, the water discharge start valve is provided in the cistern, and the position thereof is a lower position relative to the intermediate opening valve provided to the water intake pipe. As a result, when a larger water discharge amount is required as compared to the case of opening the intermediate opening valve, the water discharge start valve is opened, thereby making it possible to supply the flush water in the cistern to the water discharge path.

Further, the toilet bowl flush device according to the present invention may have a structure in which: the open end is set as a water intake opening for water discharge for large flushing, and the intermediate opening valve is set as a water intake opening for water discharge for small flushing; and the intermediate opening valve is provided with a valve body holding mechanism (opening and closing operation mechanism) for holding the intermediate opening valve at a valve opening position at a time of the water discharge for small flushing and for returning the intermediate opening valve to a valve closing position at a time of the water discharge for large flushing.

In the toilet bowl flush device according to the present invention constructed as described above, the open end of the water intake pipe is set as an water intake opening for the water discharge for large flushing, and the intermediate opening valve provided in the midway of the water intake pipe is set as an water intake opening for the water discharge for small flushing. Further, for making a choice between the water discharge for small flushing and the water discharge for large flushing, the toilet bowl flush device includes the valve body holding mechanism for opening and closing the intermediate opening valve. Therefore, in the water discharge for large flushing and the water discharge for small flushing, the water level limit for water discharge changes. As a result, it becomes possible to arbitrarily choose the water discharge amount for large flushing and the water discharge amount for small flushing.

Further, the toilet bowl flush device according to the present invention may further include a depth changing mechanism for changing a depth of the intermediate opening valve relative to a high water level in the cistern.

According to this structure, by using the depth changing mechanism, the position of the intermediate opening valve can be arbitrarily adjusted in the vertical direction of the cistern. Therefore, with the change in the position of the intermediate opening valve, the limit water level for water discharge at the time of opening the intermediate opening valve can be changed. As a result, it becomes possible to discharge water of a desired water discharge amount.

Note that, it is sufficient for the structure of the depth changing mechanism to be capable of arbitrarily changing the depth of the intermediate opening relative to the water level of the cistern in the height direction of the cistern.

Further, the toilet bowl flush device according to the present invention may be constructed to include: a movable over flow pipe provided upright in the cistern; and a sleeve which is provided with the intermediate opening valve and is slidable with respect to the water intake pipe, in which: the depth adjusting mechanism converts an operation with respect to the over flow pipe into a vertical movement of the sleeve relative to the water intake pipe, and transmits the vertical movement to the sleeve.

In this structure, the over flow pipe is provided in the cistern. Further, the water intake pipe includes the sleeve provided with the intermediate opening valve. Further, the over flow pipe is movable, and the operation with respect to the over flow pipe is converted into the vertical movement of the sleeve through the depth adjusting mechanism to be transmitted to the sleeve. As a result, it becomes possible to position the intermediate opening valve at any depth by the vertical movement of the sleeve. Note that, here, the operation of the over flow pipe corresponds to an operation involving a change in a state of the over flow pipe such as the vertical movement of the over flow pipe and the rotation of the over flow pipe.

Further, the toilet bowl flush device according to the present invention may have a structure in which: the over flow pipe has on an outer periphery thereof a helical groove extending in a vertical direction of the over flow pipe, and has a bracket provided thereto, which moves in the vertical direction of the over flow pipe following to rotation of the helical groove, is provided; and the sleeve is connected to the bracket and moves in the vertical direction of the over flow pipe in response to an operation of rotating the over flow pipe.

In this structure, the helical groove is formed on the outer periphery of the over flow pipe. Further, there is provided the bracket engaging with the helical groove. The bracket moves in the vertical direction of the over flow pipe following to the rotation of the helical groove accompanied with the operation of the over flow pipe. Further, the sleeve formed with the intermediate opening valve is connected to the bracket, and the sleeve moves in the vertical direction together with the bracket. That is, in this structure, the operation of rotating the over flow pipe causes the vertical movement of the sleeve. Therefore, it becomes possible to set the depth of the intermediate opening valve by the operation of the over flow pipe.

Further, the toilet bowl flush device according to the present invention may have a structure in which: at least one of the water discharge start valve and the intermediate opening valve is provided with a cylinder for driving a valve body; and the cylinder is connected to a supply device for supplying a drive medium for driving the valve body to the cylinder.

In this structure, when operating the water discharge start valve, the intermediate opening valve, or the like, the opening/closing operation is performed by using the cylinder for driving the valve body. Therefore, it is not necessary to provide a complicated link mechanism required for the opening/closing operation in the cistern, so a simple structure of the cistern can be realized.

Further, the toilet bowl flush device according to the present invention may have a structure in which: the cylinder is provided to each of the water discharge start valve and the intermediate opening valve, and the supply device is provided with a control device for individually controlling a supplying operation of the drive medium to each cylinder; and the control device includes a sensor for detecting a utilization time of the toilet bowl, and based on the utilization time thereof, the control device chooses the cylinder to be supplied with the drive medium.

In this structure, the cylinder is provided to each of the water discharge start valve and the intermediate opening valve. The supplying operation of the drive medium to each cylinder is controlled by the control device. Further, the control device includes the sensor for detecting the utilization time of the toilet bowl, and chooses the cylinder to be supplied with the drive medium according to the utilization time. Thus, the water discharge according to the use of the user is automatically performed.

Further, there may be provided a structure in which the cylinder is provided at a higher position relative to a high water level in the cistern.

According to this structure, the cylinder is provided in the higher position relative to the high water level in the cistern. Therefore, the cylinder is not affected by water pressure, so is operated by little force. That is, it is possible to adopt a simple supplying device in which a supply pressure for the drive medium is low.

Further, there may be provided a structure in which: the valve body connected to the cylinder is a float valve; the drive medium to be supplied to the cylinder is air; and the supply device supplies air so that an inner pressure of the cylinder is maintained to be equal to or more than 1.08 atm and equal to or less than 1.35 atm.

In this structure, air is supplied to the cylinder for driving the valve body to operate the valve bodies of the water discharge start valve, the intermediate opening valve, and the like. Further, when supplying air, the pressure (air pressure) in the cylinder is maintained to be equal to or more than 1.08 atm, and equal to or less than 1.35 atm. Therefore, also in the case where the float valve is adopted for each of the water discharge start valve and the intermediate opening valve, the closing operation of the float valve associated with the decline of the water level, is not interrupted. That is, by maintaining the air pressure within the above-mentioned range, the float valve can be opened without loosing the valve closing function of the float valve.

As described above, according to the present invention, it is possible to provide the toilet bowl flush device capable of accurately quantifying the water discharge amount. Further, it is also possible to provide the toilet bowl flush device capable of downsizing the cistern.

DETAILED DESCRIPTION OF THE INVENTION

Figure 1:
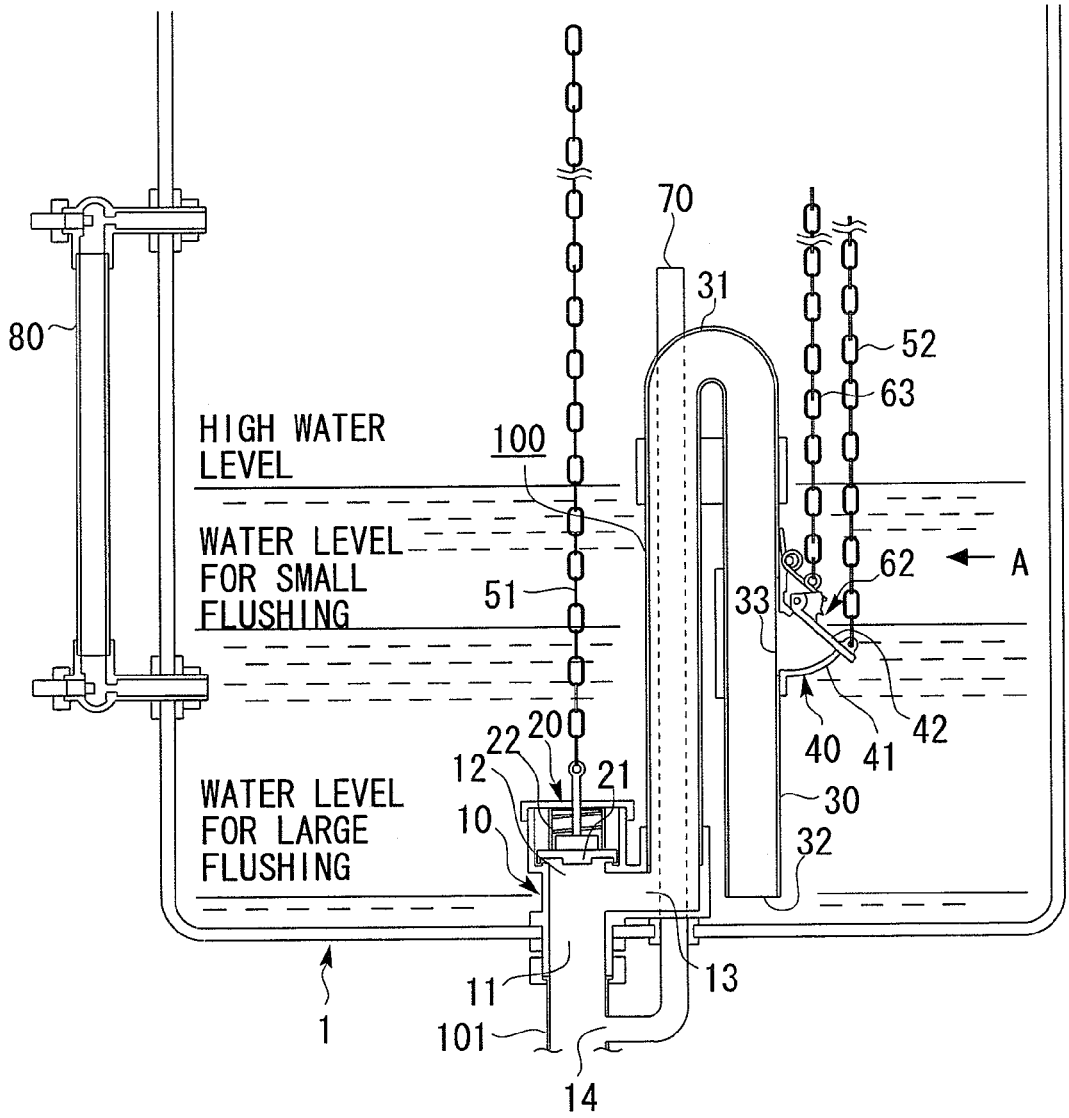
FIG. 1 is a schematic structural view of a toilet bowl flush device according to an embodiment of the present invention.

Hereinafter, a best embodiment of the present invention will be described with reference to the drawings.

A toilet bowl flush device 100 according to this embodiment includes a valve housing 10 provided on a bottom portion of a cistern 1, a water discharge start valve 20 integrated into the valve housing 10, a water intake pipe 30 extending from the bottom portion to an upper portion of the cistern 1, an intermediate opening valve 40 provided in a midway of the water intake pipe 30, an over flow pipe 70 supported by the valve housing 10, an operation mechanism 50 for performing opening/closing operations of the intermediate opening valve 40 and the water discharge start valve 20, and a water supply mechanism (not shown) for supplying flush water to the cistern 1. The flush water supplied into the cistern 1 is discharged to a water discharge pipe (water discharge path) 101 through the valve housing 10 when the operation mechanism 50 is operated.

The valve housing 10 is a valve housing 10 of a multi-branched type having open portions 11, 12, 13, and 14 in four directions as shown in FIG. 1. The main open portion 11 facing the bottom portion of the cistern 1 is connected to the water discharge pipe 101 which extends through the bottom portion of the cistern 1 and reaches the valve housing 10. Further, the open portion 14 which opens toward a depth direction of FIG. 1 in the valve housing 10 is connected to the over flow pipe 70 extending to the upper portion of the cistern 1. Further, with regard to the two remaining open portions 12 and 13 positioned in the cistern 1, the water discharge start valve 20 is integrated into the one open portion 12 and the other open portion 13 is connected to the water intake pipe 30 extending to the upper portion of the cistern 1.

The water discharge start valve 20 includes a valve body 21 connected to a chain 51, which extends from the operation mechanism 50, for operating the water discharge start valve, and a spring hook 22 for biasing the valve body 21 toward a valve seat of the valve housing 10. The water discharge start valve 20 is closed in an ordinal state. Note that, according to this embodiment, the ordinal state corresponds to a non-actuation state (non-operating state) of the operation mechanism 50.

The water intake pipe 30 constitutes a syphon flow path including a bent portion 31 of a reverse U shape in a middle thereof, the bent portion 31 being positioned in the upper portion of the cistern 1 as a turning point, and an open end (hereinafter, referred to as water intake opening 32) of the water intake pipe 30 on a water intake side opens toward the bottom portion of the cistern 1.

Specifically, the water intake pipe 30 extends to the upper portion of the cistern 1 from a connection portion of the valve housing 10, as a starting point, and further, returns in the cistern 1 through the bent portion 31 of the reverse U shape positioned in the upper portion of the cistern 1. The open end 32 opens at the bottom portion of the cistern 1.

The bent portion 31 of the reverse U shape constitutes a trap serving as a retaining portion for the water stopping air. Further, in the following description, a portion formed of the bent portion 31 is simply referred to as a trap.

Figure 2:
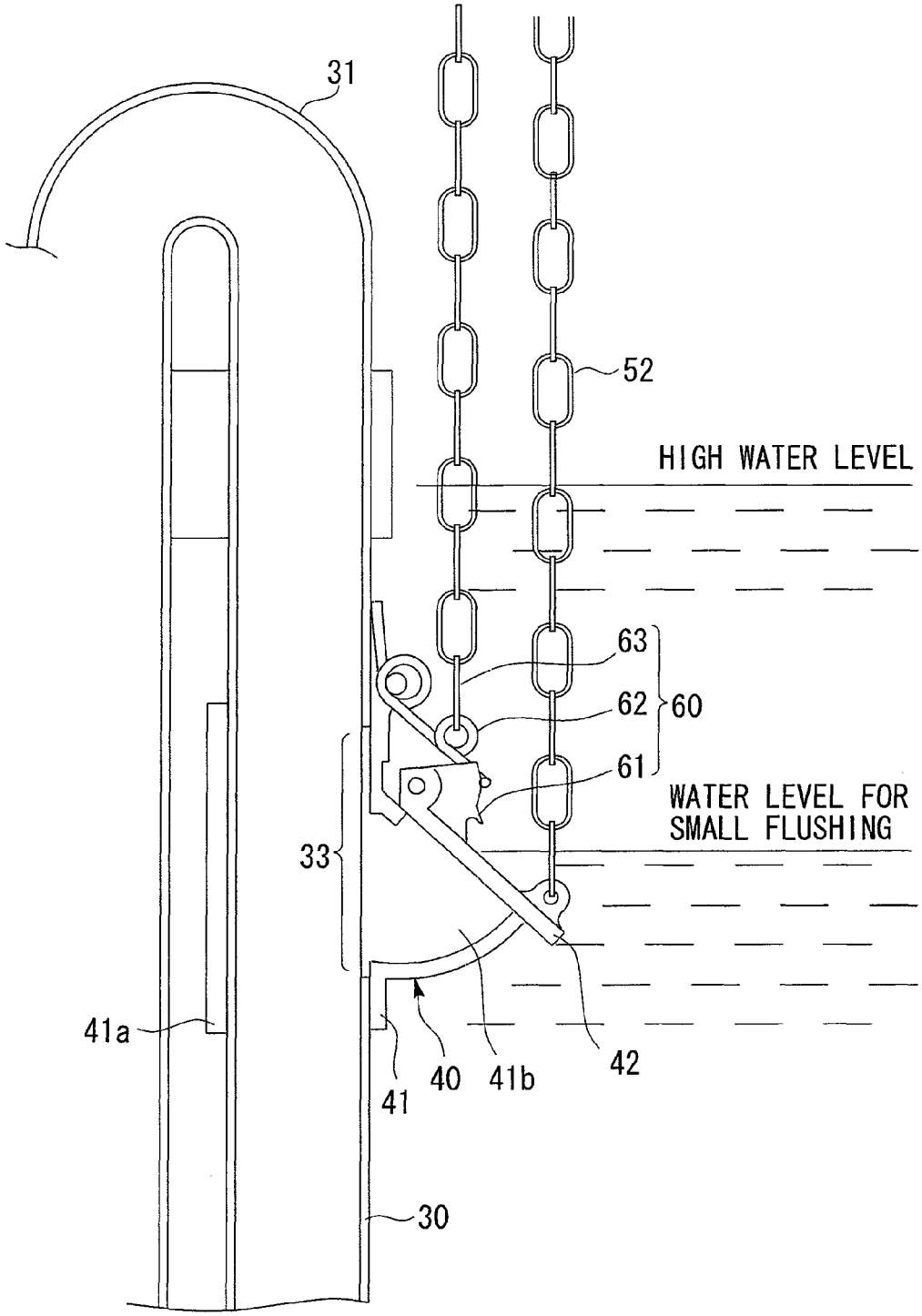
FIG. 2 is a view showing a valve body holding mechanism of an intermediate opening valve according to the embodiment.
Figure 3:
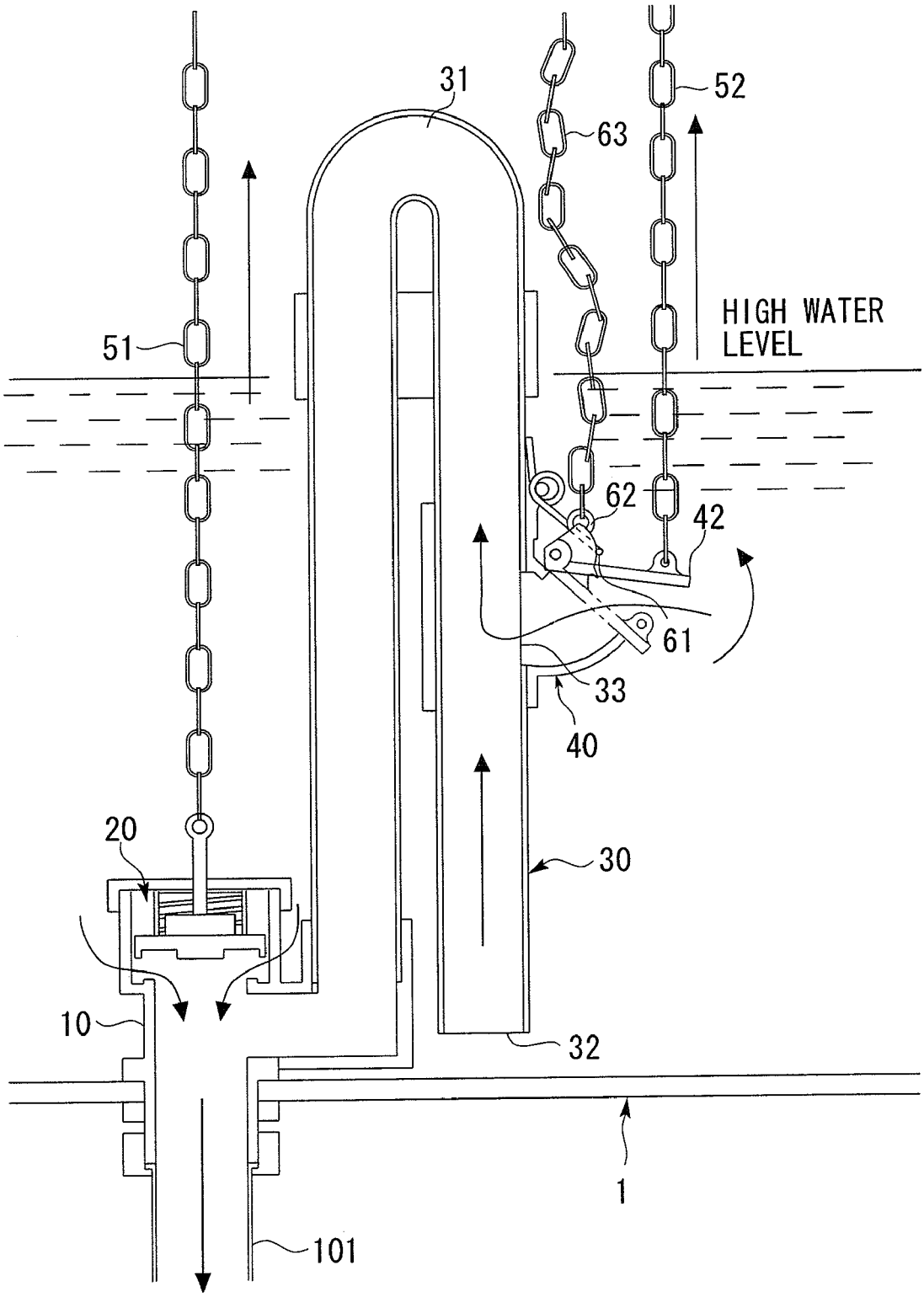
FIG. 3 is a view showing open/closed states of the intermediate opening valve in an early stage of water discharge for small flushing.
Figure 4:
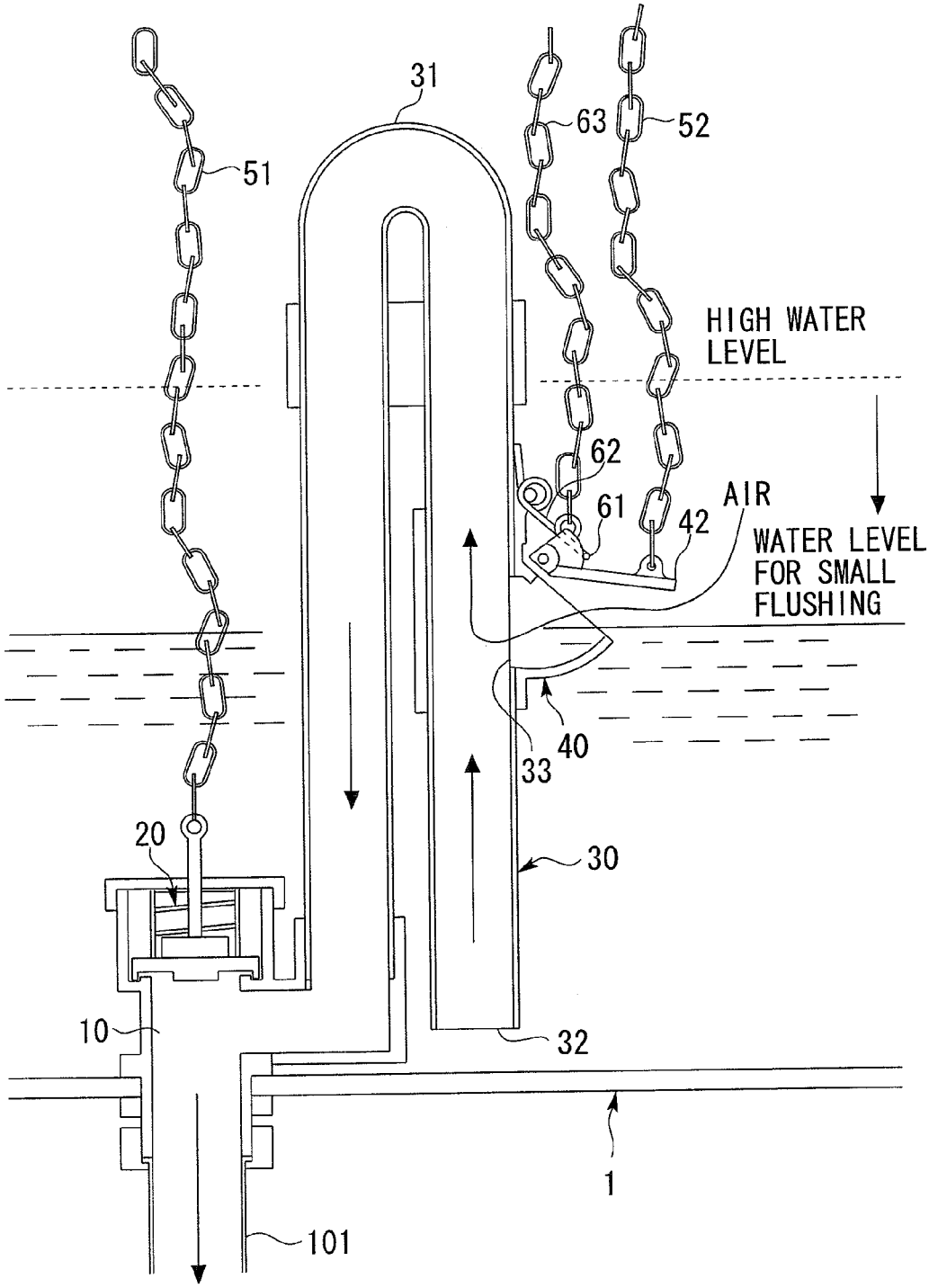
FIG. 4 is a view showing a flow of flush water and water stopping air in a late stage of the water discharge for small flushing.

Subsequently, a description will be made of the intermediate opening valve 40 with reference to FIG. 2.

The intermediate opening valve 40 includes a valve housing 41 of a sleeve shape, which is provided at a higher position relative to the water discharge start valve 20 and in the path extending from the water intake opening 32 to the trap 31, and a valve body 42 connected to a chain 52, which extends from the operation mechanism, for operating the intermediate opening valve.

The valve housing 41 includes a sleeve 41*a* having an inner diameter substantially equal to an outer diameter of the water intake pipe 30 and a pipe-like member 41*b*, which passes through the sleeve 41*a* and reaches the wall surface of the water intake pipe 30. The valve body 42 is provided to the valve housing 41 with an edge of the pipe-like member 41*b* serving as a valve seat.

Further, on the water intake pipe 30 side, a long open portion 33 (intermediate opening valve) is formed in a vertical direction of the water intake pipe 30. By moving the sleeve 41*a* constituting the valve housing 41 in the vertical direction of the water intake pipe 30, it is possible to adjust a substantial height of the intermediate opening valve 40 relative to the water intake pipe 30. In other words, by moving the sleeve 41*a* up and down, a depth of the intermediate opening valve 40 can be changed relative to a high water level in the cistern 1.

Note that, the outer diameter and the inner diameter of the sleeve 41*a* forming the valve housing 41 can be arbitrarily changed, and the sleeve 41*a* may be formed not only in a shape of the above-mentioned outer sleeve, but also in a shape of an inner sleeve.

Further, in this embodiment, for setting the depth of the intermediate opening valve 40, the over flow pipe 70 provided in the cistern 1 is operated, thereby making it possible to change the depth of the intermediate opening valve 40.

Figure 12:
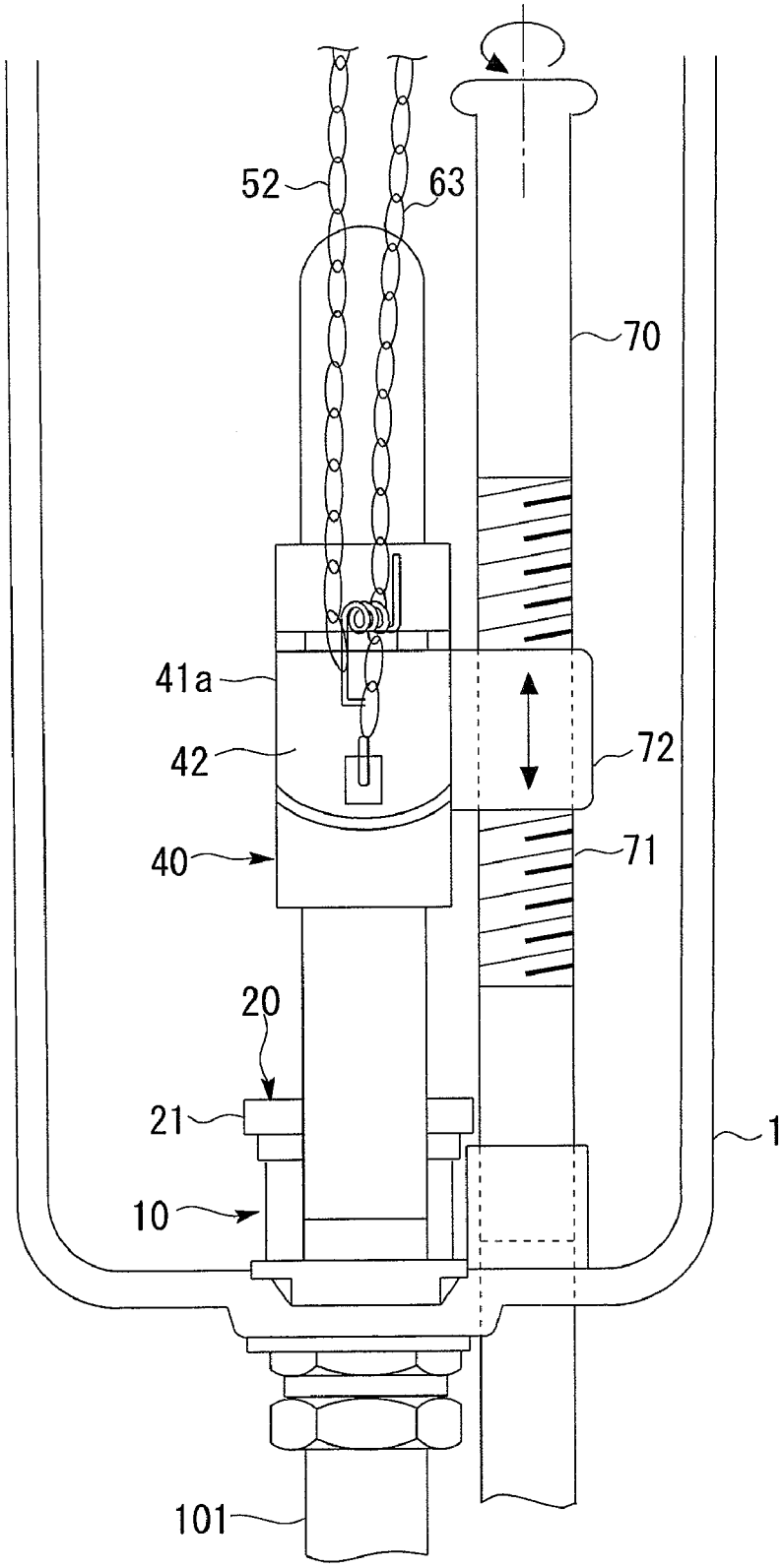
FIG. 12 is a view showing a water intake pipe and an overflow pipe which are viewed in a direction of an arrow A of FIG. 1.
Figure 13:
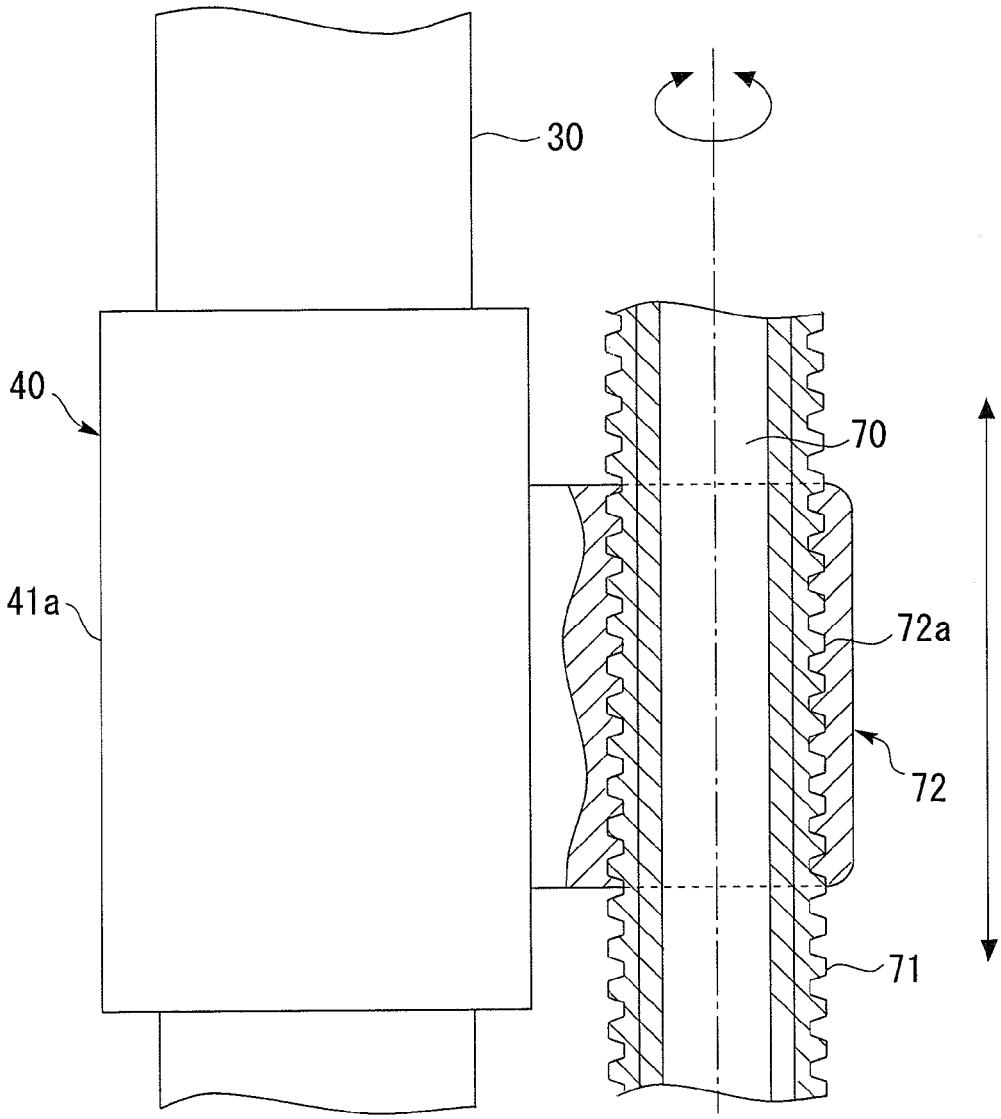
FIG. 13 is an enlarged sectional view of a main portion of FIG. 12.

First, on an outer periphery of the over flow pipe 70 as shown in FIGS. 12 and 13, there is formed a groove 71 (male thread) of a helical shape extending in a vertical direction of the over flow pipe 70. A tubular bracket 72 having a tooth engaging with the groove is provided to the over flow pipe 70. The bracket 72 and the sleeve 41*a* constituting the intermediate opening valve 40 are formed so as to be integrated to each other. The bracket 72 is supported along both the over flow pipe 70 and the water intake pipe 30 so as to be movable in the vertical direction of the cistern 1.

Further, the over flow pipe 70 is supported so as to be rotatable with respect to the valve housing 10. Due to the vertical movement of the bracket 72 following rotation of the over flow pipe 70, the sleeve 41*a* moves in the vertical direction of the water intake pipe 30.

That is, through the operation of rotating the over flow pipe 70, the sleeve 41*a* moves. Therefore, according to the operation of the over flow pipe 70, the depth of the intermediate opening valve 40 can be changed relative to the high water level.

Note that, the setting of the depth of the intermediate opening valve 40 is an operation performed for setting an appropriate water discharge amount at the time of discharging water for small flushing (at the time of discharging a relatively small amount of water for flushing urine or the like in the toilet bowl). By setting the depth of the intermediate opening valve 40, the water discharge amount appropriate for various uses can be obtained. The setting of the depth of the intermediate opening valve 40 and the water discharge amount will be described later in detail. The over flow pipe 70, the bracket 72, and the like constitute a depth changing mechanism. Note that, water discharge for large flushing refers to discharge of a relatively large amount of water for flushing solid waste or the like in the toilet bowl.

Subsequently, a description will be made of a valve body holding mechanism 60 provided to the intermediate opening valve 40.

The intermediate opening valve 40 includes the valve body holding mechanism 60 having a function of holding the valve body 42 provided to the intermediate opening valve 40 and a function of returning the valve body 42 which is positioned in a valve opening position to a valve closing position according to choice.

Figure 5:
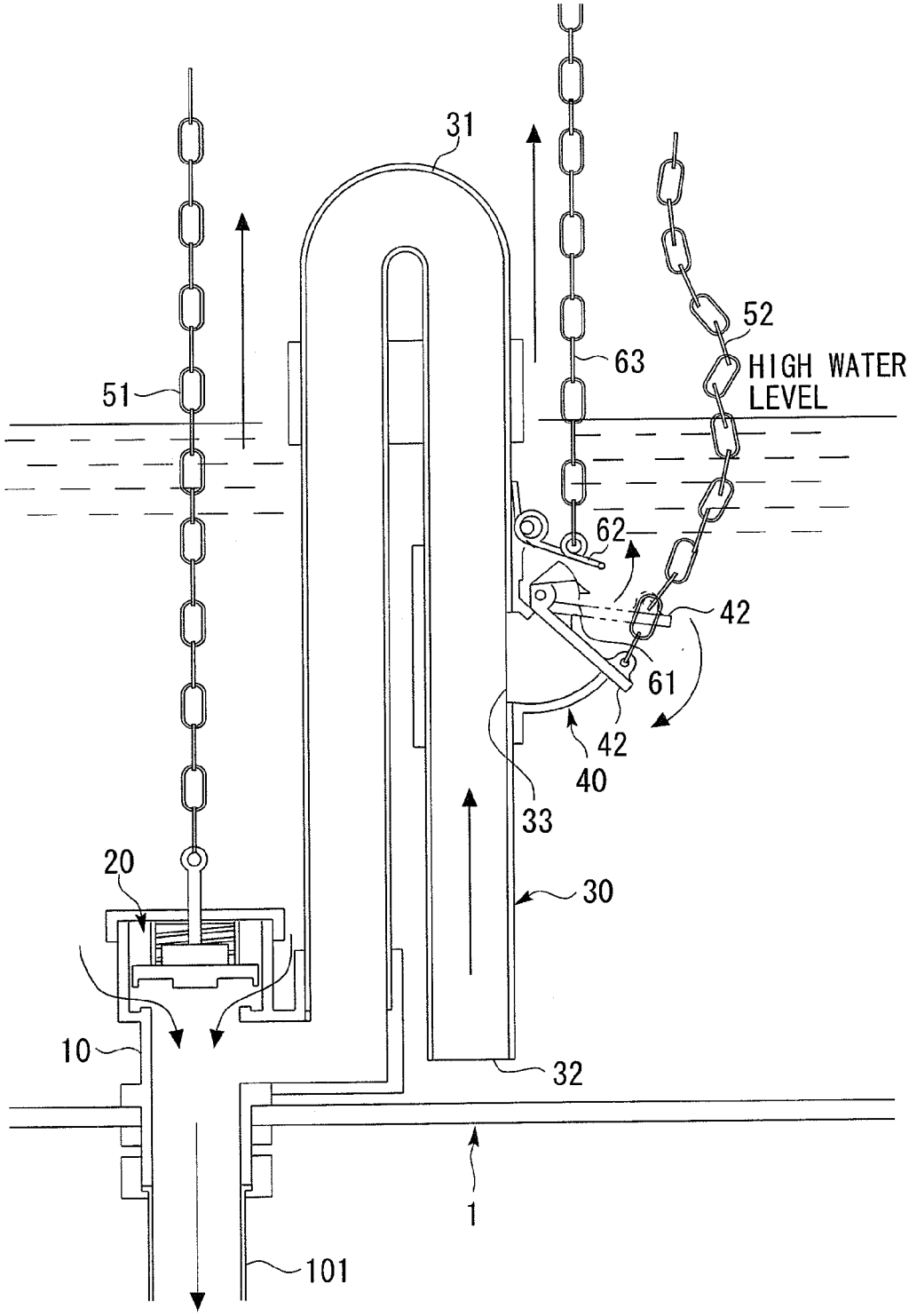
FIG. 5 is a view showing open/closed states of the intermediate opening valve in an early stage of water discharge for large flushing.
Figure 6:
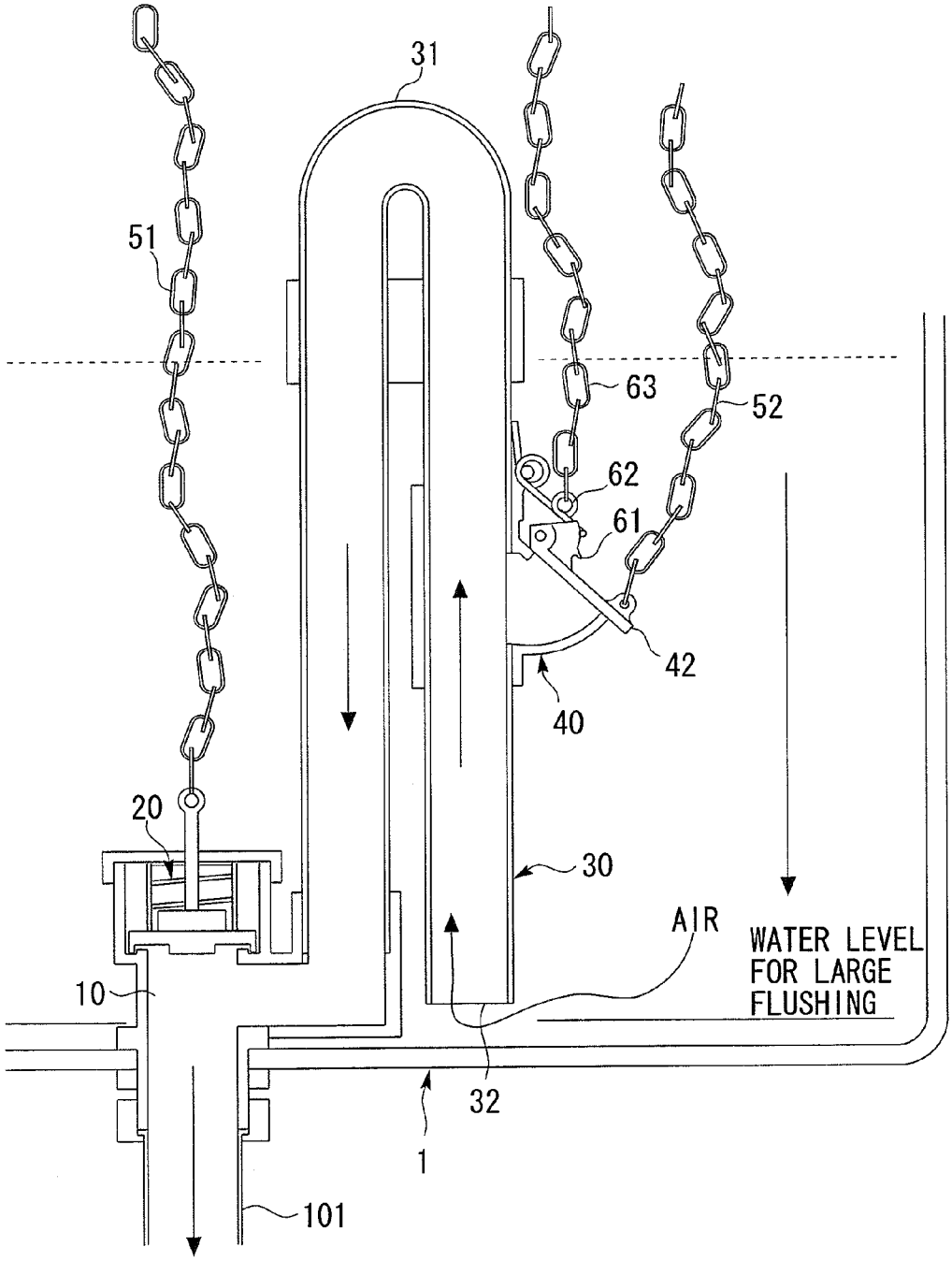
FIG. 6 is a view showing a flow of the flush water and the water stopping air in a late stage of the water discharge for large flushing.

The valve body holding mechanism 60 includes a locking claw 61 formed on an upper surface of the valve body 42, a spring hook 62 holding the valve body 42 in the valve opening position by engaging with the locking claw 61, and a chain 63 for operating the spring hook such that the operation mechanism 50 and the spring hook 62 are connected to each other, and receives the operation of the chain 52 for operating the intermediate opening valve and the operation of the chain 63 for operating the spring hook, the chain 52 and the chain 63 extending from the operation mechanism 50, thereby performing opening/closing operations of the valve body 42. As shown in FIGS. 3 to 6, by lifting the chain 52, which extends from the operation mechanism 50, for operating the intermediate opening valve, the valve body 42 moves up (see FIG. 3). By this movement, the locking claw 61 engages with a front end of the hook 62, thereby holding the intermediate opening valve 40 at the opening position (see FIG. 4). In order to cancel the engagement between the locking claw 61 and the spring hook 62, as shown in FIG. 5, the chain 63 for operating the spring hook is lifted, thereby canceling the engagement between the locking claw 61 and the spring hook 62, and the valve body 42 then naturally returns to the valve closing position (see FIG. 6).

Subsequently, a description will be made of the operation mechanism 50 with reference to FIGS. 7 to 9.

Figure 8:
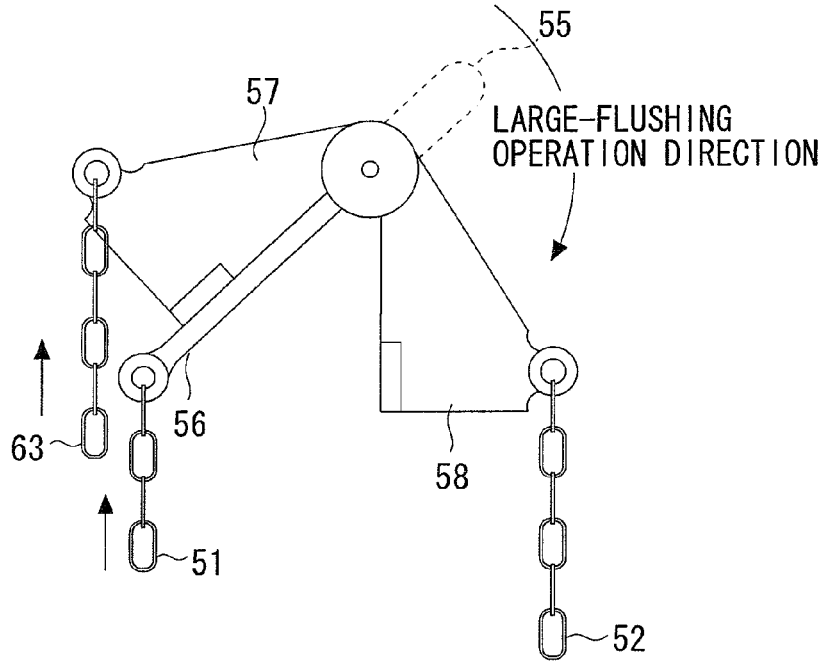
FIG. 8 is a view showing an actuation state of the operation mechanism in a large-flushing operation direction.
Figure 9:
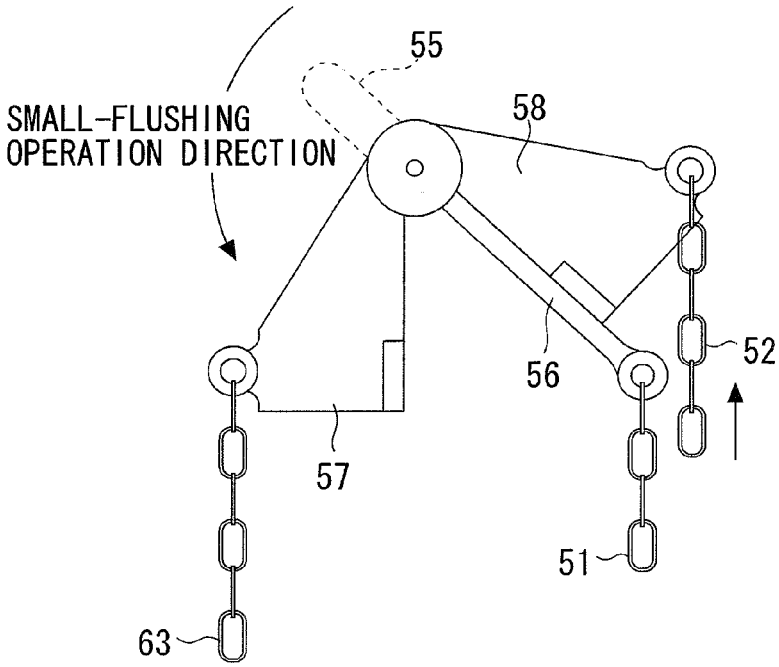
FIG. 9 is a view showing an actuation state of an operation mechanism in a small-flushing operation direction.

The operation mechanism 50 includes an operation lever 55 provided in the upper portion of the cistern 1 that freely rotates, a neutral member 56 which rotates together with the operation lever 55, a large-flushing operation plate 57 which freely rotates towards one side (left side as shown in FIG. 8) of the neutral member 56 about a support shaft 51*a* for the operation lever 55 as a fulcrum, and a small-flushing operation plate 58 which freely rotates towards the other side (right side as shown in FIG. 9) of the neutral member 56. Those members are respectively connected through chains and link mechanisms (not shown) to the valve bodies 21 and 42 and the spring hook 62 for the intermediate opening valve 40, which are the objects to be operated.

Specifically, the neutral member 56 is connected to the chain 51 for the water discharge start valve, which is used for opening the water discharge start valve 20. The large-flushing operation plate 57 is connected to the chain 63 for the spring hook, which is used for closing the intermediate opening valve 40. The small-flushing operation plate 58 is connected to the chain 52 for operating the intermediate opening valve, which is used to open the intermediate opening valve 40.

Figure 7:
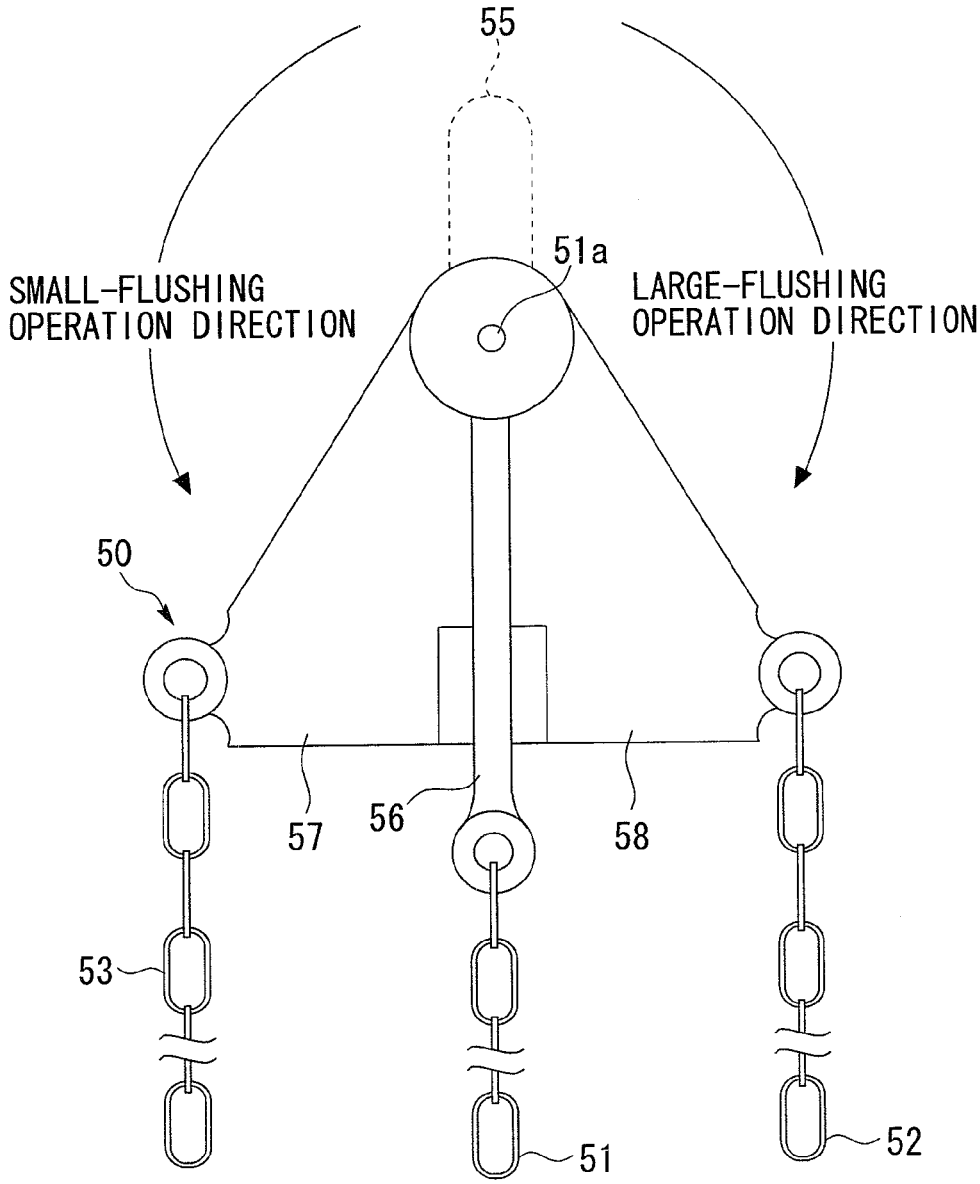
FIG. 7 is a view showing a non-actuation state of an operation mechanism (non-operating state) according to the embodiment.

A description is made of actuation states of the respective members, in which the operation (i.e., rotational movement) of the operation lever 55 toward the left side of FIG. 7 is defined as a direction for a small-flushing operation, and the operation of the operation lever 55 toward the right side of FIG. 7 is defined as a direction for a large-flushing operation direction. The neutral member 56 lifts the chain 51 for the water discharge start valve when moved in both the large-flushing operation direction and the small-flushing operation direction to open the water discharge valve 20.

The large-flushing operation plate 57 lifts up the spring hook 62 for the intermediate opening valve 40 by using the chain 63 for the spring hook at the time of operation in the large-flushing operation direction (see FIG. 8). At the time of operation in the large-flushing operation direction, by the movement of the neutral member 56 and the large-flushing operation plate 57, the water discharge start valve 20 opens and the spring hook 62 for the intermediate opening valve 40 is lifted, thereby releasing the valve body 42 from being held in the valve opening position, so the intermediate opening valve 40 closes (see FIG. 5).

On the other hand, the small-flushing operation plate 54 lifts up the valve body 42 of the intermediate opening valve 40 by using the chain 52 for operating the intermediate opening valve at the time of operation in the small-flushing operation direction (see FIG. 9). At the time of operation in the small-flushing operation direction, by the movement of the neutral member 56 and the small-flushing operation plate 58, the water discharge start valve 20 opens and the valve body 42 of the intermediate opening valve 40 is lifted, thereby allowing the intermediate opening valve 40 to be held in the valve opening position (see FIG. 3).

Subsequently, a principle of water discharge by the toilet bowl flush device 100 according to the present invention will be described considering the change in water level in the cistern 1.

(A Time of Water Discharge for Large Flushing)

First, when the operation lever 55 is operated in the large-flushing operation direction, the water discharge start valve 20 opens, and the flush water flows into the water intake pipe 30 through the water discharge start valve 20. The flush water serves as priming to occur a syphon phenomenon in the water intake pipe 30. Due to reduction in pressure in the pipe accompanied with the occurrence of the syphon phenomenon, the flush water flows into the water intake pipe 30 through the water intake opening 32 at the bottom portion of the cistern. The flush water is discharged to the water discharge pipe 101 through the water intake pipe 30.

The intermediate opening valve 40 is in the valve closing state at the time of water discharge for large flushing. Therefore, the water discharge continues until the water level reaches the water intake opening 32 at the bottom portion of the cistern. When the water level reaches the water intake opening 32, the water stopping air flows into the water intake pipe 30 through the water intake opening 32, thereby stopping the syphon phenomenon. Thus, upon the stoppage of the syphon phenomenon, the water discharge ends.

(A Time of Water Discharge for Small Flushing)

At the time of water discharge for small flushing, the operation lever 55 is operated in the small-flushing operation direction, thereby allowing the water discharge start valve 20 to open. As the syphon phenomenon occurs in the same manner as described above, the water discharge is started.

Further, at the time of water discharge for small flushing, the intermediate opening valve 40 is held in the valve opening position. When the water level in the cistern 1 reaches the intermediate opening valve 40, outside air for stopping water is taken into the water intake pipe 30 through the intermediate opening valve 40, thereby ending the water discharge.

Further, at the time of water discharge for small flushing, the intermediate opening valve 40 is held in the valve opening position by the spring hook 62. With regard to the subsequent operations, until an operation of canceling the valve opening is carried out through the operation in the large-flushing operation direction, the intermediate opening valve 40 is held in the valve opening position. Note that, in a case where an operation subsequent to the small-flushing operation is again the small-flushing operation, although the valve opening state of the intermediate opening valve 40 continues, the water level corresponding to the intermediate opening valve 40 is enough for ensuring the water discharge amount required at the time of water discharge for small flushing, so it is not particularly required to close the intermediate opening valve 40. Upon the reception of the water discharge operation for large flushing, the intermediate opening valve 40 closes. After that, the water discharge through the water intake opening 32 is enabled.

Note that, there is enough operating time of the operation lever 55 required to discharge water for the large flushing and for the small flushing to be about the time for causing the syphon phenomenon in the water intake pipe 30 to occur. The operation lever 55 is not required to be operated until the end of the water discharge. That is, the short time is enough for opening the water discharge start valve 20. After the syphon phenomenon occurs, regardless of presence/absence of the opening of the water discharge start valve 20, water discharge continues until the water level in the cistern 1 reaches a limit water level for water discharge.

A description is made of a relationship between the depth of the intermediate opening valve 40 and the water discharge amount. At the time of water discharge for small flushing, the water discharge ends when the water level in the cistern 1 reaches the intermediate opening valve 40. Accordingly, when the depth of the intermediate opening valve 40 relative to the high water level in the cistern 1 is large, the limit water level for water discharge at the time of water discharge for small flushing is set to a low position. Therefore, more flush water can be discharged as compared to a previous case. When the depth of the intermediate opening valve 40 is small, it is possible to discharge a small amount of water.

According to the toilet bowl flush device 100 as described in this embodiment, every time the operation lever 55 is switched to the direction of water discharge for large flushing or the direction of water discharge for small flushing, the limit water level for water discharge changes. Therefore, at both the time of water discharge for large flushing and the time of water discharge for small flushing, an appropriate amount of flush water can be accurately and continuously supplied through a simple operation of the operation lever 55.

Further, in this embodiment, without using the float valve, the flush water in the cistern 1 can be discharged, so the maximum use of a capacity of the cistern 1 can be realized. Further, by utilizing a suction force in the water intake pipe 30 as a result of the occurrence of the syphon phenomenon, water discharge is performed, so as compared to a conventional method in which a vertical difference in water level is utilized to perform water discharge, the cistern 1 can be made smaller in a height direction thereof.

Further, in this embodiment, the water discharge amount at the time of water discharge for small flushing can be adjusted following to a change in the depth of the intermediate opening valve 40 through the operation of the over flow pipe 70. Therefore, when adjusting the water discharge amount, the water discharge amount can be changed without inserting hands and fingers in the cistern 1. That is, by gripping a tip of the over flow pipe 70 facing a water surface of the flush water to rotate the over flow pipe 70, the water discharge amount can be adjusted without wetting hands and fingers by the flush water.

Note that, the embodiment as described above is just one embodiment, and the detail thereof can be appropriately changed in conformity with the specification of the toilet bowl flush device 100.

Figure 10:
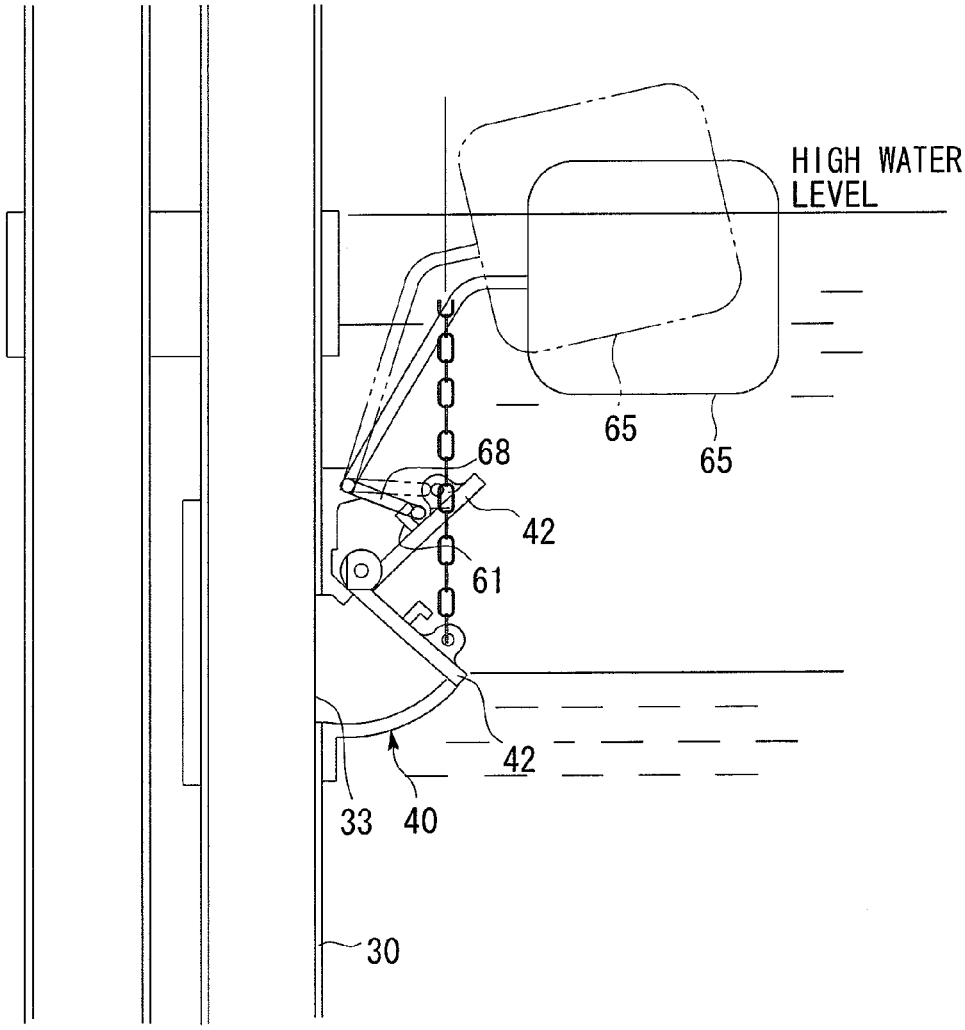
FIG. 10 is a view in which a float is adopted for a valve body holding mechanism of the intermediate opening valve according to the embodiment.

For example, in the above-mentioned embodiment, in order to return the intermediate opening valve 40 held in the opening position to the valve closing position, it is required to perform an operation in the large-flushing operation direction, however, as shown in FIG. 10, there may be provided a structure in which an L-shaped hook 68 is connected to a float 65 so that the holding of the valve body 42 in the valve opening position is cancelled by a vertical movement of the float 65 according to change in the water level.

Specifically, as shown in FIG. 10, an angle formed between the float 65 and the hook 68 is set to an angle, at which, when the water level is lower than the high water level, the hook 68 descends to a position where the intermediate opening valve 40 can be held in the valve opening position, and at which, when the water level is at the high water level, the hook 68 ascends to a position where the valve opening state can be cancelled.

With this structure, the intermediate opening valve 40 is always in the valve closing position, but when the float 65 descends by the water discharge for small flushing, the intermediate opening valve 40 (valve body 42) opened by the water discharge for small flushing is locked by the hook 68 to be held in the valve opening position. Further, in response to the end of the water discharge, the water level in the cistern 1 returns to the high water level. Then, restraint of the intermediate opening valve 40 is released to be returned to the valve closing position again.

Further, at the time of operation in the large-flushing operation direction, the hook 68 descends to the position, where the intermediate opening valve 40 can be held thereby, as the water level declines. However, since, at the time of operation in the large-flushing operation direction, the opening/closing operation of the intermediate opening valve 40 is not performed, the intermediate opening valve 40 rests at the valve closing position without being locked by the hook 68.

Further, the structure and the shape of the water discharge start valve 20 and those of the intermediate opening valve 40 are satisfactory as long as those enables opening/closing in correspondence with the opening/closing state as occasion demands. For example, those maybe constructed of slidable valves using pistons or the like. The above-mentioned water intake pipe 30 may have a structure of a sectional type, in which the height of the water intake opening is changeable, a stretchable structure, or the like. According to various specifications, the structure can be changed.

Further, a water level observation gauge 80 connecting the bottom portion and the upper portion of the cistern 1 is provided on an outside of the cistern 1, and the water level of the cistern 1 may be observed from the outside of the cistern 1. Preferably, a water stop valve 81 is provided in a flow path extending from the cistern 1 to the water level observation gauge 80, and the water stop valve is opened at a time of water level observation, thereby allowing the flush water to flow into the water level observation gauge 80.

Figure 11:
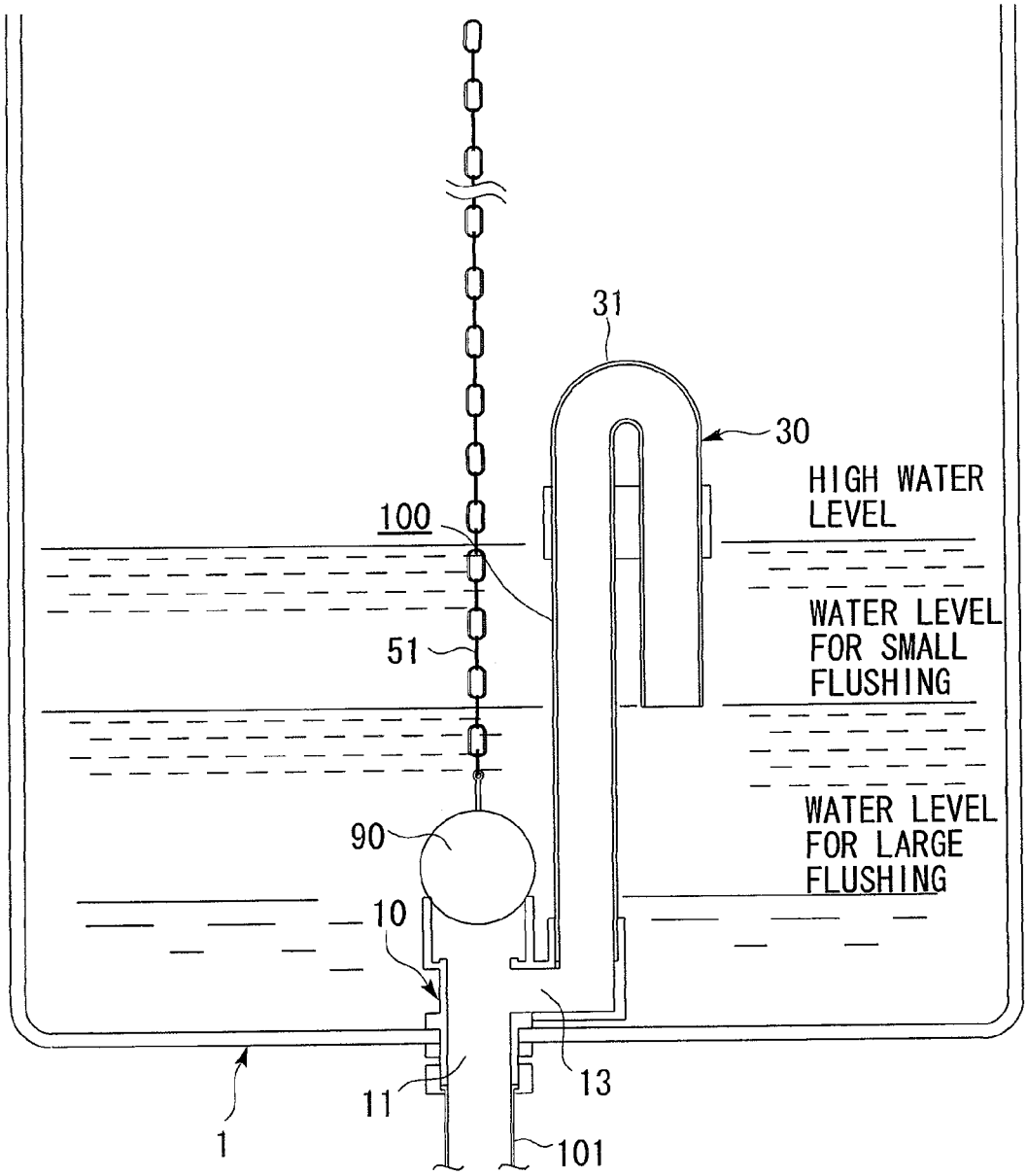
FIG. 11 is a view in which a float valve is adopted for a water discharge valve according to the embodiment.

Further, in this embodiment, the valve body 21 biased to the valve seat is used. However, for example, as shown in FIG. 11, a float valve 90 (ball tap) can be used as the water discharge start valve 20. In this case, the water discharge start valve 20 may be used as a water discharge valve for use in large flushing.

Note that, also in a case where the float valve 90 is used as the water discharge start valve 20, the float valve 90 does not lose a function of introducing priming water to the water intake pipe 30. Therefore, at the time of water discharge for small flushing, the float valve 90 is slightly opened, thereby allowing the water discharge to be automatically performed until the water level reaches the limit water level for water discharge for small flushing without operating the operation lever 55 thereafter. Further, with this structure, the water discharge start valve 20 functions as the water discharge valve for large flushing. Therefore, it is not required to extend the water intake pipe 30 to the bottom portion of the cistern 1, and it is also possible to directly intake the flush water for small flushing through the intermediate opening valve 40. That is, the intermediate opening valve 40 becomes unnecessary, so it is possible to quantify the water discharge for small flushing with a simple structure.

Figure 19:
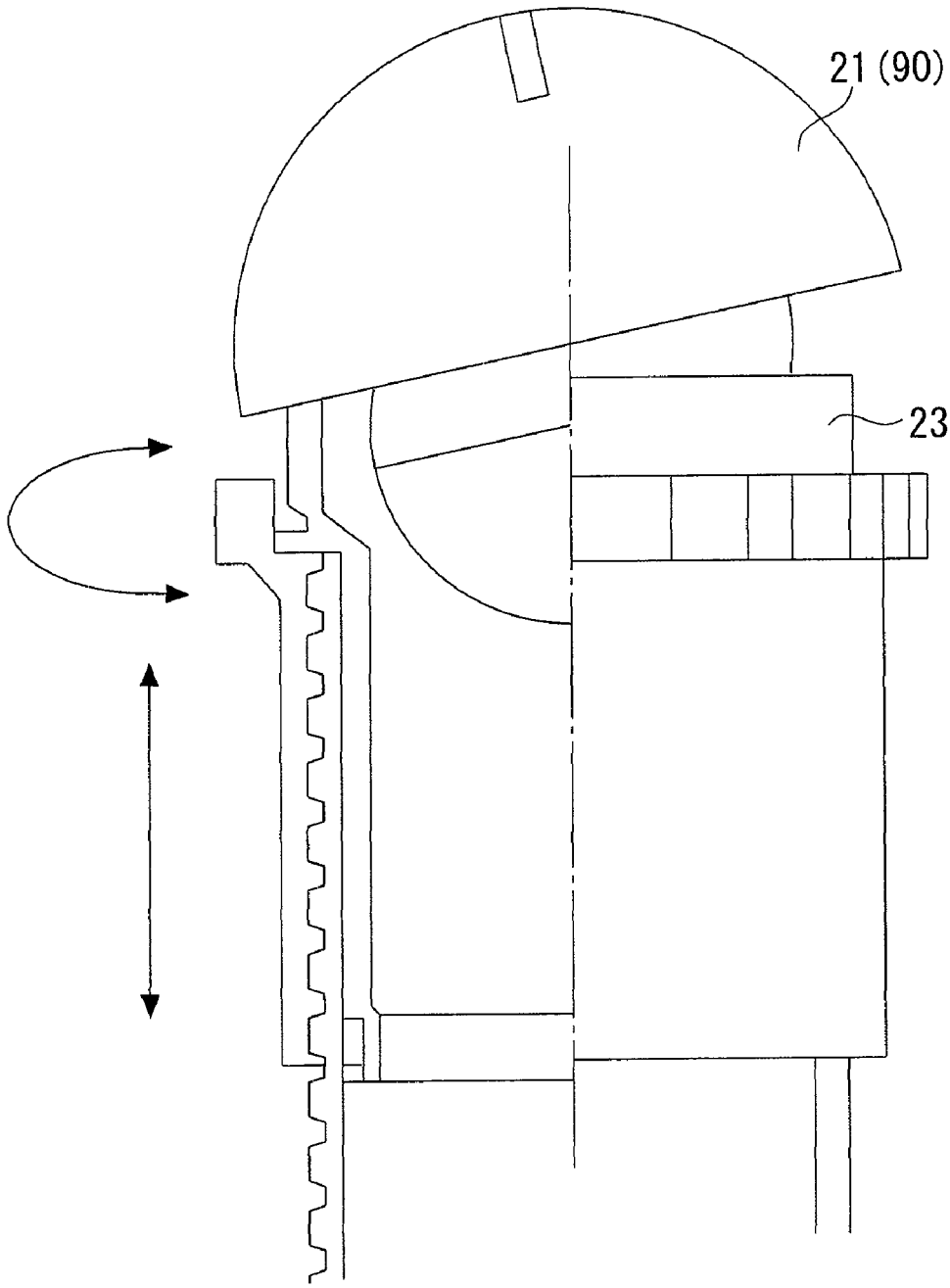
FIG. 19 is a schematic structural view of a depth adjusting mechanism according to the embodiment.

Further, in this embodiment as described above, as the depth adjusting mechanism, the sleeve 41*a* can move up and down relative to the water intake pipe 30. However, it is not necessary, for example, as shown in FIG. 19, there may be provided such a structure that the valve seat 23, on which the valve body 21 (float valve 90) is seated, is provided so as to be capable of ascending/descending relative to the valve housing 10.

Further, in this embodiment, with regard to the opening/closing operations of the intermediate opening valve 40 and the water discharge start valve 20, the opening/closing operations are performed without using a force of electricity or the like. However, it is not necessary, and it is also possible to control opening/closing of the various valve bodies by using an electric operation mechanism composed of an electric motor, a switch, and the like.

Note that, as the electric operation mechanism, for example, an operation mechanism 110 as shown in FIGS. 14 to 17 can be used as an example.

In this example, the intermediate opening valve 40 is formed of the float valve 40*a* and air cylinders 111 and 112 for raising the water discharge start valve 20 and the intermediate opening valve 40, respectively, are provided in the upper portion of the cistern 1. Further, an air supply device 120 for supplying air (drive medium) to the air cylinders 111 and 112 at appropriate timings is provided on a side surface of the cistern 1 (see FIG. 15).

The air supply device 120 includes an air pump 121 for supplying air to the air cylinders 111 and 112, a switching valve 122 for switching the air hoses 111*a* and 112*a* extending from the air pump 121 to the air cylinders 111 and 112, respectively, a human body sensor 123 for sensing use of the toilet bowl, a water discharge start sensor 124 for sensing movement of a user promoting the water discharge, and a control device 125 for choosing the air cylinder 111 or 112 to be supplied with air according to outputs of various sensors.

Figure 14:
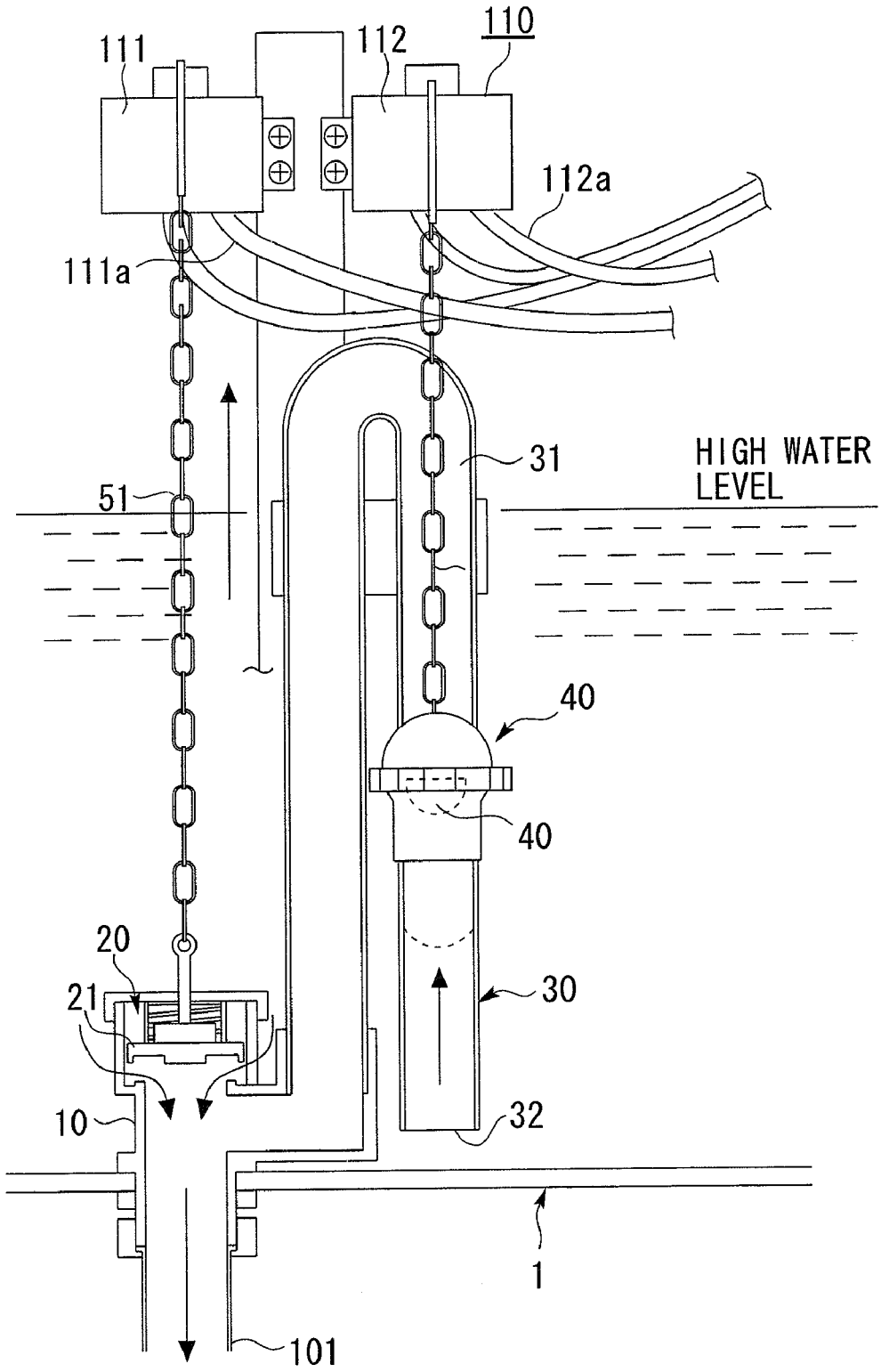
FIG. 14 is a view showing an example in which an operation mechanism of an electric driving type is adopted for the operation mechanism according to the embodiment.
Figure 15:
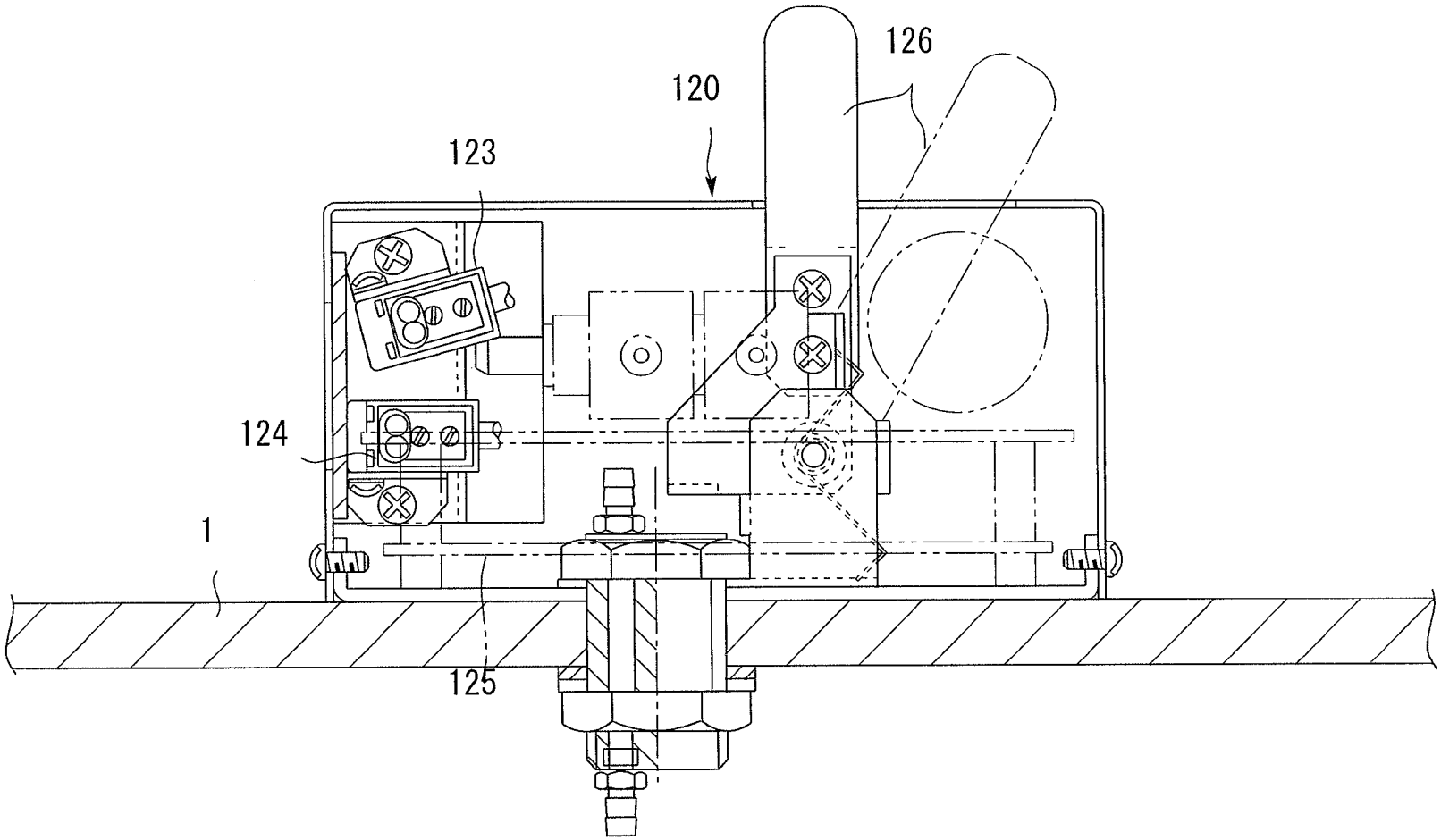
FIG. 15 is a perspective view of an air supply device according to the operation mechanism of FIG. 14 viewed from a top thereof.
Figure 16:
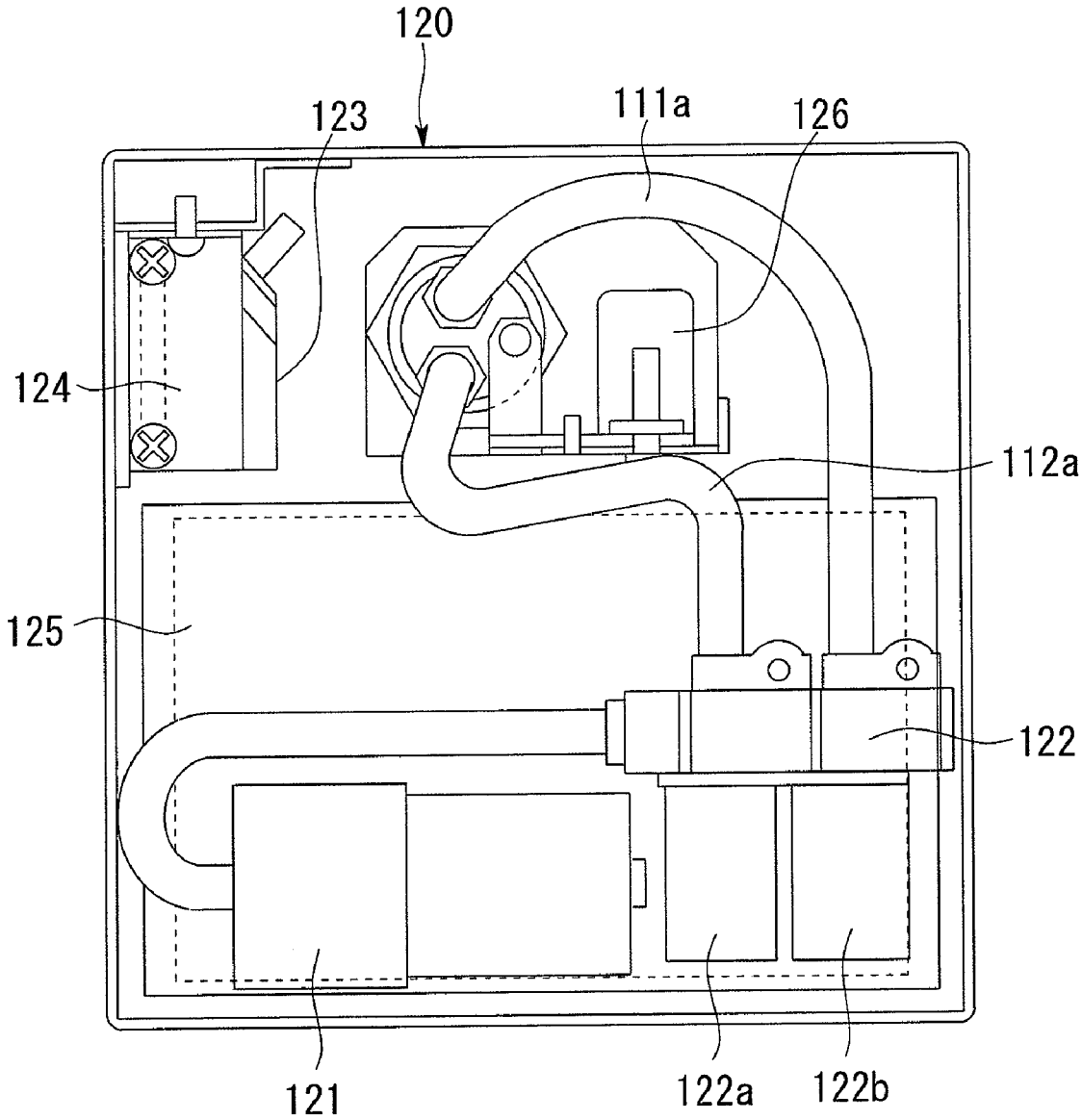
FIG. 16 is a perspective view of the air supply device according to the operation mechanism of FIG. 14 viewed from a front thereof.

The air cylinders 111 and 112 for opening the water discharge start valve 20 and the intermediate opening valve 40, respectively, are fixed to the upper portion of the over flow pipe 70 as shown in FIG. 14. From the air cylinders 111 and 112, the valve bodies 21 and 40*a* of the water discharge start valve 20 and the intermediate opening valve 40 are suspended, respectively.

Figure 17:
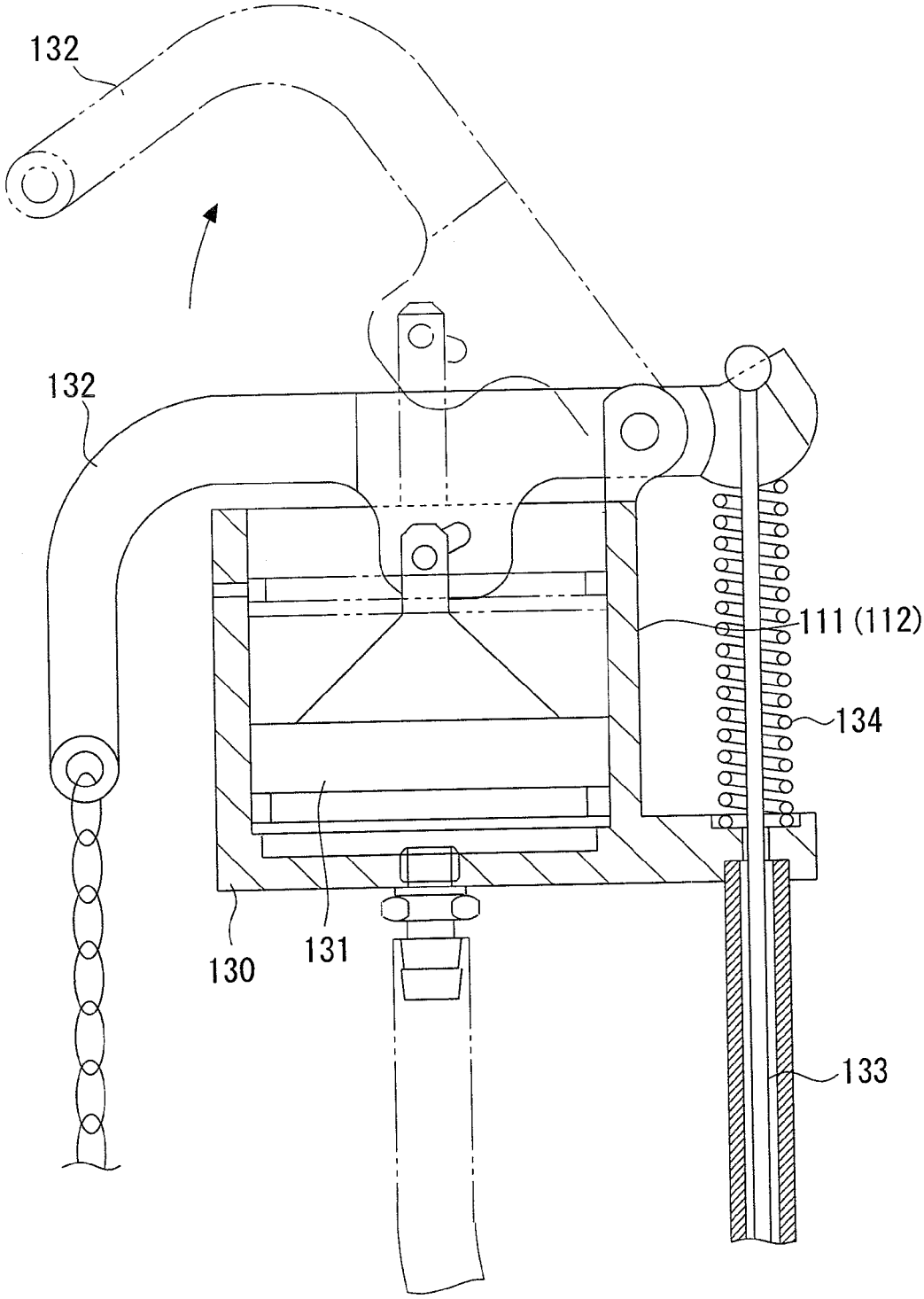
FIG. 17 is a schematic structural view showing an inside of an air cylinder provided to the operation mechanism of the electric driving type.

Note that, each of the air cylinders 111 and 112 includes, as shown in FIG. 17, a simple link mechanism 132 for converting a vertical movement of a piston 131 incorporated in a cylinder main body 130 into a raising movement of each of the valve bodies 21 and 40*a*, respectively. Further, in the link mechanism 132, there are provided, in addition to a return spring 134 for returning the link mechanism 132 to an initial position, a wire 133 for manual operation. By pulling the wire 133, even when the air pump 121 is not in operation, the valve bodies 21 and 40*a* can be opened. Note that, the wire 133 for manual operation is connected to a manual operation lever 126 provided in the air supply device 120. By pulling the manual operation lever 126, the wire 133 can be operated.

The air pump 121 is connected to the air cylinders 111 and 112 through the switching valve 122 and the air hoses 111*a* and 112*a*, respectively. A discharge pressure of the air pump 121 is adjusted such that an air pressure in the air cylinders 111 and 112 is equal to or more than 1.05 atm and equal to or less than 1.5 atm, preferably, equal to or more than 1.08 atm and equal to or less than 1.35 atm. Further, in order to avoid being affected by a water pressure, the air cylinders 111 and 112 are provided in positions higher than the high water level of the flush water so as to be capable of operating even with low-pressure air as described above.

Note that, in the air cylinder 112 for the intermediate opening valve 40, an inertial pressure thereof is set to about 1.1 atm, thereby making it possible to preferably opening the float valve 40*a* without inhibiting the closing operation of the float valve 40*a*. Specifically, when the inner pressure of the air cylinder 112 is too high, the float valve 40*a* is not closed even when the water level declines. When the inner pressure of the air cylinder 112 is too low, there may arise a problem in that the float valve 40*a* cannot be opened. Thus, in this embodiment, the discharge pressure of the air pump 121 is maintained at an appropriate value by a regulator or the like as described above, to thereby solve the problem.

The switching valve 122 contains a solenoid valves 122*a* and 122*b* which receive a switching signal outputted from the control device 125 to block and open paths extending to the air cylinders 111 and 112.

The control device 125 is a device for choosing the air cylinder 111 or 112 to be supplied with air, and operated the switching valve 122 according to the outputs of the various sensors 123 and 124 as described above.

Note that, the human body sensor 123 includes an infrared ray sensor contained in the air supply device 120, a pressure sensor (seating sensor) provided to a toilet seat, and the like. The infrared ray sensor is used for sensing the user, and the pressure sensor is used for making judgment between use for large excretion or use for small excretion. Further, the water discharge start sensor 124 is formed of the infrared ray sensor or the like. When the user holds a hand over the water discharge start sensor 124, the water discharge sensor 124 outputs it to the control device 125. The control device 125 drives the air pump 121 and operates the switching valve 122 according to the output of the human body sensor 123.

Figure 18:
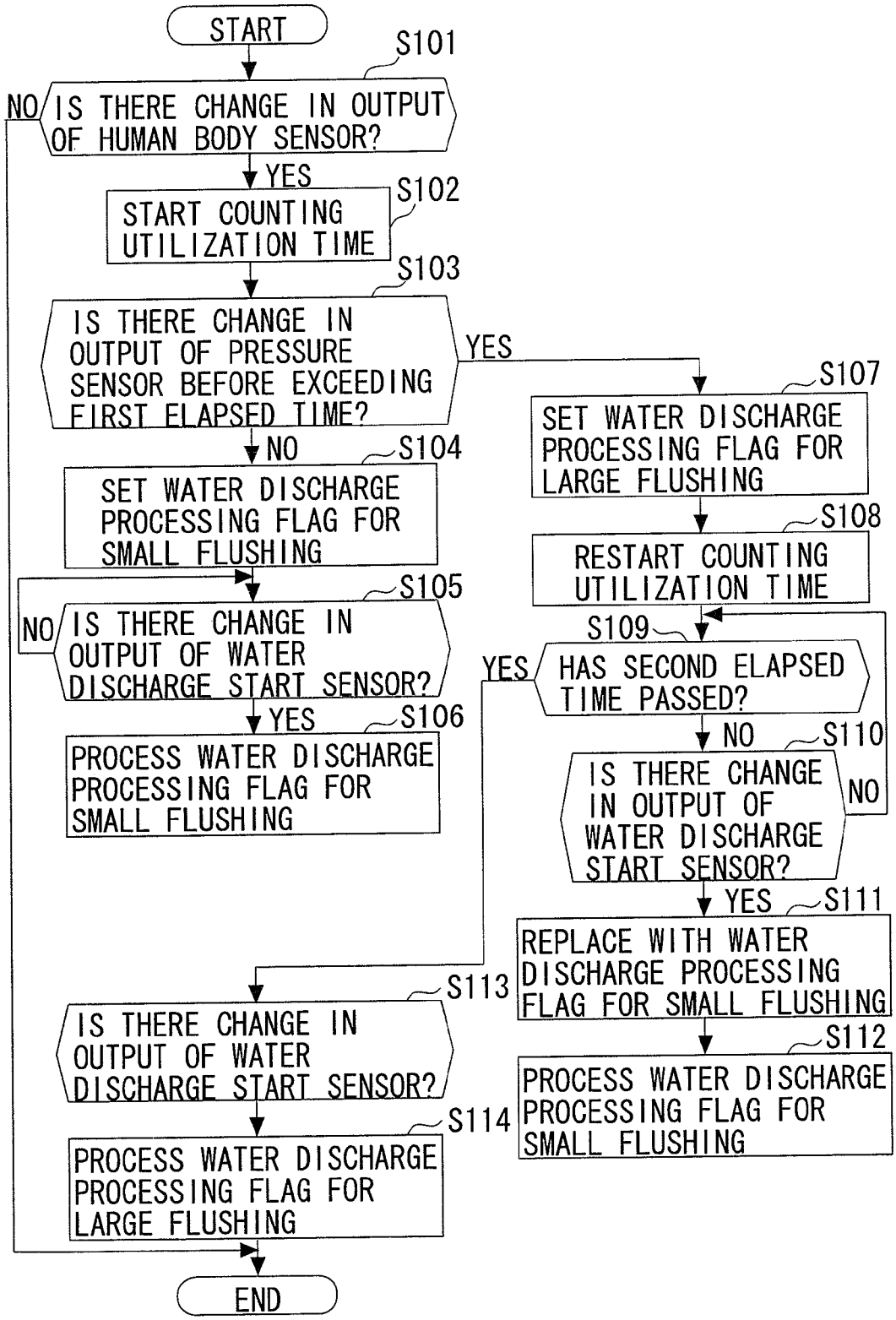
FIG. 18 is a flow chart of a program for performing processing in a control device provided to the operation mechanism of the electric driving type.

Note that, FIG. 18 is a flow chart showing contents of a series of processings performed in the control device 125.

First, the control device 125 reads the output of the human body sensor 123, receives sensing of a human body by the human body sensor 123 (Step S101), and starts counting a utilization time (Step S102).

Subsequently, in a case where the utilization time exceeds a first elapsed time while no change is caused in the output of the pressure sensor (Step S103), it is assumed to be a use for small excretion by a male, and a water discharge processing flag is set for a purpose of small flushing (Step S104).

Note that, the first elapsed time is a time which is set in consideration of an average time it takes for a female to sit on a toilet seat. When no change is observed in the pressure sensor even after the first elapsed time, it can be recognized to be the use for small excretion by a male, which does not involve seating on the toilet seat. Further, the pressure sensor serves for sensing the seating of the user, and is constructed so as not to detect mere raising and lowering of the toilet seat.

The control device 125 receives that there is a change in the output of the water discharge start sensor 124 and processes the water discharge processing flag for small flushing (Steps S105 and S106). Specifically, the paths are opened to both the water discharge opening valve 20 and the intermediate opening valve 40 to supply air to the air cylinders 111 and 112.

In a case where the output change of the pressure sensor is detected before the first elapsed time passes, the judgment is made on the use by a female or the use for large excretion by a male, and the water discharge processing flag is set for a purpose of large flushing (Step S107).

Subsequently, the control device 125 again starts counting the utilization time (Step S108) Further, in a case where, before the utilization time reaches a second utilization time (Step S109), there is an input to the water discharge start sensor 124 (Step S110), it is assumed to be the use for small excretion by a female, the control device 125 replaces the water discharge processing flag having the purpose of large flushing with the water discharge processing flag having the purpose of small flushing (Step S111), and processes the water discharge processing flag for small flushing (Step S112). Note that, the second utilization time can be defined to be a shortest time, which is required for a female to use the toilet seat for small excretion, or the like.

Further, in a case where a change in the output of the water discharge start sensor 124 is detected after the second utilization time has passed (Step S113), it is assumed to be the water discharge for large flushing, and the control device 125 processes the water discharge processing flag for large flushing (Step S114). Specifically, the path extending to the water discharge start valve 20 is opened and the path extending to the intermediate opening valve 40 is closed, thereby supplying air only to the air cylinder 111 for the water discharge start valve 20.

As described above, in the control device 125, according to the outputs of the various sensors, the water discharge processing flag is selectively established, and according to the water discharge processing flag, the switching valve 122 and the air pump 121 are controlled. Note that, the above-mentioned processing contents are only an example, and various modifications of those are possible in detail according to various specifications.

According to the toilet bowl flush device according to the present invention, a cylinder to be supplied with air, that is the valve body to be opened is chosen based on the utilization time of the toilet bowl. Thus, the water discharge according to the use of the user is automatically performed.

The invention claimed is:

1. A toilet bowl flush device which discharges flush water in a cistern to a water discharge path for toilet bowl flushing, comprising:

a water intake pipe having an open end in the cistern;

a water discharge start valve for introducing priming water for starting water discharge into the water intake pipe;

a trap for forming an air stagnation section at a position midway from the open end of the water discharge start valve of the water intake pipe, the position being at a higher position relative to the open end; and a rotational operation lever for determining an amount of flush water to be discharged, whereby the directional movement chosen and used by said operation lever selects between a first predetermined amount of flush water and a second predetermined amount of flush water, wherein said second predetermined amount of flush water is greater than said first predetermined amount of flush water, wherein when said operation lever is rotated in a first direction, said first predetermined amount of flush water is discharged, and wherein when said operation lever is rotated in a second, opposite direction, said second predetermined amount of flush water is discharged.

2. A toilet bowl flush device according to claim 1, wherein the water intake pipe has midway from the trap to the open end of the water intake valve an intermediate opening valve, which emerges from the water in the cistern as a water level in the cistern declines.

3. A toilet bowl flush device according to claim 2, wherein the water discharge start valve is provided at a lower position relative to the intermediate opening valve provided in the cistern and in the water intake pipe.

4. A toilet bowl flush device according to claim 2, wherein:

the open end is set as a water intake opening for water discharge for said second predetermined amount of flush water, and the intermediate opening valve is set as a water intake opening for water discharge for said first predetermined amount of flush water; and the intermediate opening valve is provided with a valve body holding mechanism for holding the intermediate opening valve in a valve opening position at a time of the water discharge for said first predetermined amount of flush water and for returning the intermediate opening valve to a valve closing position at a time of the water discharge for said second predetermined amount of flush water.

5. A toilet bowl flush device according to claim 2, further comprising a depth changing mechanism for changing a depth of the intermediate opening valve relative to a high water level in the cistern.

6. A toilet bowl flush device according to claim 5, further comprising:

a movable over flow pipe provided upright in the cistern; and a sleeve which is provided with the intermediate opening valve and is slidable with respect to the water intake pipe, wherein:

the depth adjusting mechanism converts an operation with respect to the over flow pipe into a vertical movement of the sleeve relative to the water intake pipe, and transmits the vertical movement to the sleeve.

7. A toilet bowl flush device according to claim 6, wherein:

the over flow pipe has on an outer periphery thereof a helical groove extending in a vertical direction of the over flow pipe, and a bracket provided thereto, which moves in the vertical direction of the over flow pipe following the rotation of the helical groove provided; and the sleeve is connected to the bracket and moves in the vertical direction of the over flow pipe in response to an operation of rotating the over flow pipe.

8. A toilet bowl flush device according to claim 2, wherein:

at least one of the water discharge start valve and the intermediate opening valve is provided with a cylinder for driving a valve body; and the cylinder is connected to a supply device for supplying a drive medium for driving the valve body to the cylinder.

9. A toilet bowl flush device according to claim 8, wherein:

the cylinder is provided to each of the water discharge start valve and the intermediate opening valve, and the supply device is provided with a control device for individually controlling a supplying operation of the drive medium to each cylinder; and the control device includes a sensor for detecting a utilization time of the toilet bowl, and based on the utilization time thereof, the control device chooses the cylinder to be supplied with the drive medium.

10. A toilet bowl flush device according to claim 8, wherein the cylinder is provided at a higher position relative to a high water level in the cistern.

11. A toilet bowl flush device according to claim 8, wherein:

the valve body connected to the cylinder is a float valve;

the drive medium to be supplied to the cylinder is air; and the supply device supplies air so that an inner pressure of the cylinder is maintained to be equal to or more than 1.08 atm and equal to or less than 1.35 atm.

* * * * *